US011236740B2

(12) United States Patent
Inagaki et al.

(10) Patent No.: US 11,236,740 B2
(45) Date of Patent: Feb. 1, 2022

(54) SEALED COMPRESSOR AND FREEZER DEVICE OR REFRIGERATOR EQUIPPED WITH SAME

(71) Applicant: PANASONIC APPLIANCES REFRIGERATION DEVICES SINGAPORE, Singapore (SG)

(72) Inventors: Ko Inagaki, Shiga (JP); Masanori Kobayashi, Shiga (JP); Hiroyuki Kawano, Shiga (JP)

(73) Assignee: PANASONIC APPLIANCES REFRIGERATION DEVICES SINGAPORE, Singapore (SG)

( * ) Notice: Subject to any disclaimer, the term of this patent is extended or adjusted under 35 U.S.C. 154(b) by 526 days.

(21) Appl. No.: 14/912,745

(22) PCT Filed: Aug. 27, 2014

(86) PCT No.: PCT/JP2014/004392

§ 371 (c)(1),
(2) Date: Feb. 18, 2016

(87) PCT Pub. No.: WO2015/033536

PCT Pub. Date: Mar. 12, 2015

(65) Prior Publication Data

US 2016/0201661 A1 Jul. 14, 2016

(30) Foreign Application Priority Data

Sep. 3, 2013 (JP) ..... JP2013-181864
Jun. 20, 2014 (JP) ..... JP2014-126894
Jul. 8, 2014 (JP) ..... JP2014-140609

(51) Int. Cl.
*F04B 39/02* (2006.01)
*F04B 9/04* (2006.01)
(Continued)

(52) U.S. Cl.
CPC ..... *F04B 39/023* (2013.01); *F04B 9/045* (2013.01); *F04B 17/03* (2013.01);
(Continued)

(58) Field of Classification Search
None
See application file for complete search history.

(56) References Cited

U.S. PATENT DOCUMENTS 2,102,403 A * 12/1937 Bixler ..... F25B 31/023 417/281
4,632,644 A * 12/1986 Fritchman ..... F16C 19/10 417/415

(Continued)

FOREIGN PATENT DOCUMENTS

CN 101855451 A 10/2010
CN 102562527 A 7/2012

(Continued)

OTHER PUBLICATIONS

Chinese Search Report dated Mar. 15, 2017 for the related Chinese Patent Application No. 201480048557.0.

(Continued)

*Primary Examiner* — Peter J Bertheaud
*Assistant Examiner* — Geoffrey S Lee
(74) *Attorney, Agent, or Firm* — Hamre, Schumann, Mueller & Larson, P.C.

(57) ABSTRACT

Sealed container (102) houses electric unit (110) equipped with stator (114) and a rotor (116), and compression unit (112) disposed above electric unit (110). Compression unit (112) includes shaft (118) that includes main shaft portion (120) and eccentric shaft portion (122), and cylinder block (124). Compression unit (112) further includes connection portion (136) that connects piston (128) reciprocatively inserted into cylinder (130) and eccentric shaft portion
(Continued)

(122), and a thrust bearing that supports a load of shaft (118) in a vertical direction. The thrust bearing includes an upper race in contact with a flange portion of shaft (118), a lower race in contact with a thrust surface of cylinder block (124), and a rolling element. An overall height of sealed container (102) is sized not to exceed a length six times larger than a diameter of piston (128).

8 Claims, 20 Drawing Sheets

(51) Int. Cl.

| | |
|---|---|
| ***F04B 17/03*** | (2006.01) |
| ***F25B 31/02*** | (2006.01) |
| ***F04B 39/00*** | (2006.01) |
| ***F04B 39/12*** | (2006.01) |

(52) U.S. Cl.
CPC ..... *F04B 39/0094* (2013.01); *F04B 39/0246* (2013.01); *F04B 39/121* (2013.01); *F25B 31/023* (2013.01); *F25B 2500/01* (2013.01)

(56) References Cited

U.S. PATENT DOCUMENTS

| | | | | |
|---|---|---|---|---|
| 6,948,418 | B2 * | 9/2005 | Kim | F04B 39/0094 417/415 |
| 8,721,304 | B2 * | 5/2014 | Inagaki | F04B 39/0027 384/611 |
| 8,844,317 | B2 * | 9/2014 | Park | F01C 21/02 62/498 |
| 10,001,116 | B2 * | 6/2018 | Yanase | F04B 35/04 |
| 10,371,134 | B2 * | 8/2019 | Tsuboi | F16C 35/06 |
| 2004/0221716 | A1 * | 11/2004 | Kim | F04B 39/0094 92/140 |
| 2005/0008502 | A1 * | 1/2005 | Manke | F04B 39/0094 417/313 |
| 2007/0025864 | A1 * | 2/2007 | Cho | F04B 39/0253 417/415 |
| 2007/0110599 | A1 * | 5/2007 | Suss | F04B 39/0094 417/415 |
| 2008/0247889 | A1 * | 10/2008 | Bin-Nun | F25B 1/02 417/415 |
| 2009/0136369 | A1 * | 5/2009 | Kakiuchi | F04B 39/0246 417/410.1 |
| 2011/0027111 | A1 | 2/2011 | Inagaki et al. | |
| 2011/0217189 | A1 * | 9/2011 | Falch | F04B 39/125 417/410.1 |
| 2012/0183419 | A1 * | 7/2012 | Kobayashi | F04B 39/0207 417/415 |
| 2013/0156617 | A1 * | 6/2013 | Bellet | F04B 27/0895 417/410.1 |
| 2013/0189132 | A1 | 7/2013 | Okada et al. | |
| 2013/0230420 | A1 | 9/2013 | Inagaki et al. | |
| 2013/0251564 | A1 * | 9/2013 | Okada | F04B 35/04 417/420 |
| 2014/0154111 | A1 * | 6/2014 | Akashi | F04B 39/0207 417/365 |
| 2014/0308140 | A1 | 10/2014 | Inagaki et al. | |
| 2014/0341763 | A1 * | 11/2014 | Kobayashi | F25B 1/00 417/415 |
| 2015/0030478 | A1 * | 1/2015 | Tsuboi | F16C 33/58 417/415 |
| 2015/0211507 | A1 * | 7/2015 | Ide | F04B 35/04 417/415 |
| 2015/0369526 | A1 * | 12/2015 | Kawano | F04B 39/0066 62/498 |
| 2016/0273579 | A1 * | 9/2016 | Akashi | F04B 39/0094 |

FOREIGN PATENT DOCUMENTS

| | | |
|---|---|---|
| CN | 203114894 U | 8/2013 |
| IN | 201103103 I1 | 9/2013 |
| JP | 2005-500476 | 1/2005 |
| JP | 2007-132261 | 5/2007 |
| JP | 2008-208812 | 9/2008 |
| JP | 2009-002352 | 1/2009 |
| JP | 2010-275981 | 12/2010 |
| JP | 2011-509365 | 3/2011 |
| JP | 2012-087715 A | 5/2012 |
| JP | 2012-145053 | 8/2012 |
| JP | 2013104328 A | 5/2013 |
| JP | 2013-133720 | 7/2013 |
| JP | 2013-148073 | 8/2013 |
| JP | 2013-160291 | 8/2013 |

OTHER PUBLICATIONS

International Search Report of PCT application No. PCT/JP2014/004392 dated Dec. 2, 2014.

Office Action issued for Japanese Patent Application No. 2015-535306, dated Jul. 10, 2018, 9 pages including English translation.

* cited by examiner

SEALED COMPRESSOR AND FREEZER DEVICE OR REFRIGERATOR EQUIPPED WITH SAME

TECHNICAL FIELD

The present invention relates to a sealed compressor which includes a thrust ball for reducing a sliding loss, and a refrigerator or a freezer device equipped with this compressor.

BACKGROUND ART

In the field of sealed compressors of this type, compact-size sealed compressors miniaturized from a viewpoint of space saving are known (for example, see PTL 1). There are also known sealed compressors whose shaft thrust bearing is constituted by a rolling bearing from a viewpoint of high efficiency (for example, see PTL 2).

A conventional sealed compressor described in PTL 1 is initially described.

FIG. 17 is a vertical cross-sectional view of a conventional sealed compressor. FIG. 18 is a cross-sectional view of a main part of the conventional sealed compressor illustrated in FIG. 17. As illustrated in FIGS. 17, 18, lubricating oil 4 is stored in a bottom portion of sealed container 2. Compressor body 6 includes electric unit 10 equipped with stator 14 and rotor 16, and compression unit 12 disposed above electric unit 10. Compressor body 6 is supported on suspension spring 8, and accommodated in sealed container 2. Electric unit 10 is a salient pole concentrated winding type DC brushless motor. Stator 14 includes an iron core, and winding directly wound around magnetic pole teeth of the iron core via insulating material. Rotor 16 includes iron core 16*a*, and permanent magnet 16*b* housed in iron core 16*a* to constitute an embedded magnet type motor.

Shaft 18 constituting compression unit 12 includes main shaft portion 20, flange portion 62 at an upper end of main shaft portion 20, and eccentric shaft portion 22 that is extended upward from flange portion 62 and is eccentric with respect to main shaft portion 20. Shaft 18 further includes oil supply mechanism 46 extending from a lower end to an upper end of shaft 18. Cylinder block 24 includes substantially cylindrical cylinder 30, and main bearing 26 rotatably supporting main shaft portion 20. An upper end surface of main bearing 26 is in contact with flange portion 62 of shaft 18 to form a thrust sliding bearing.

Piston 28 is reciprocatively inserted into cylinder 30 to form compression chamber 34 defined by cylinder 30 and valve plate 32 provided on an end surface of cylinder 30. Piston 28 is connected with eccentric shaft portion 22 via connection portion 36. Suction muffler 40 is sandwiched between valve plate 32 and cylinder head 38 to be fixed therebetween.

Stator 14 of electric unit 10 is disposed radially outside rotor 16 while maintaining a substantially constant clearance from rotor 16, and fixed to leg portion 25 of cylinder block 24. Rotor 16 is fixed to main shaft portion 20 by shrink-fit portion 42. A clearance between an upper end of rotor 16 and support portion 27 of cylinder block 24 illustrated in FIG. 18 is defined as H. A length of main bearing 26 of cylinder block 24 is defined as L. A wall thickness of support portion 27 of cylinder block 24 is defined as D. A fixing width of fixation between shrink-fit portion 42 and main shaft portion 20 is defined as W.

As illustrated in FIG. 17, rotor 16 includes overhang portions 16*c*, 16*d* provided to increase an amount of effective magnetic flux and thereby improve efficiency of electric unit 10. Accordingly, rotor 16 has a height greater than that of the iron core of stator 14 by a height of both overhang portions 16*c*, 16*d*.

Operation and effect of the sealed compressor constructed as above is hereinafter described.

When electric unit 10 is energized, rotor 16 is rotated together with shaft 18 by a magnetic field generated in stator 14. In accordance with rotation of main shaft portion 20, eccentric shaft portion 22 rotates eccentrically. This eccentric movement is converted, via connection portion 36, into reciprocating movement which reciprocates piston 28 within cylinder 30. Reciprocation of piston 28 causes compression operation of sucking refrigerant gas contained in sealed container 2 into compression chamber 34 to compress the refrigerant gas.

A lower end of shaft 18 is immersed in lubricating oil 4. Lubricating oil 4 is supplied to respective parts of compression unit 12 to lubricate sliding units by operation of oil supply mechanism 46 in accordance with rotation of shaft 18.

During compression of refrigerant gas by piston 28, a compressive load on piston 28 is further applied to eccentric shaft portion 22 via connection portion 36, and supported by main shaft portion 20 and main bearing 26.

This type of sealed compressor secures sufficient length L of main bearing 26 while reducing an overall height of the sealed compressor. Accordingly, the sealed compressor is capable of reducing a load generated by moment which increases as length L of main bearing 26 decreases, and preventing a rise of a bearing loss while securing durability.

Moreover, leg portion 25 of cylinder block 24, i.e., a part to which stator 14 is attached, has a small length to reduce the overall height.

Furthermore, wall thickness D of support portion 27 of cylinder block 24, and clearance H between the upper end of rotor 16 and support portion 27 of cylinder block 24 are both reduced to decrease the overall height of the sealed compressor by reduction of a distance between compression unit 12 and electric unit 10.

In addition, stator 14 is of a salient pole concentrated winding type having a small protrusion height of winding, and is applied to an embedded magnet type motor characterized by small size and high efficiency to decrease the overall height of the sealed compressor by reduction of a height of stator 14.

A conventional sealed compressor having a different structure according to PTL 2 is hereinafter described. Configurations similar to the corresponding configurations in PTL 1 are given similar reference numbers, and the same detailed description is not repeated.

FIG. 19 is a cross-sectional view of the conventional sealed compressor having a different structure according to PTL 2. FIG. 20 is a cross-sectional view illustrating a main part of a thrust ball bearing and surroundings included in the conventional sealed compressor illustrated in FIG. 19. FIG. 21 is a perspective view illustrating a support member of the thrust ball bearing included in the conventional sealed compressor illustrated in FIG. 20. FIGS. 22A, 22B are schematic views illustrating the thrust ball bearing in an inclined state of a shaft of the conventional sealed compressor illustrated in FIG. 20.

As illustrated in FIGS. 19, 20, main bearing 26 includes thrust surface 48 corresponding to a flat surface portion perpendicular to a shaft center, and tubular extension portion 50 that is extended upward from thrust surface 48 and has an inner surface which faces main shaft portion 20.

Thrust ball bearing 64 is constituted by upper race 52, ball 54 stored in retainer 56, lower race 58, and support member 60, and disposed on an outer circumferential side of tubular extension portion 50.

Each of upper race 52 and lower race 58 is constituted by an annular metal flat plate, and has upper and lower surfaces in parallel with each other.

As illustrated in FIG. 21, lower protrusions 60*a*, 60*b*, and upper protrusions 60*c*, 60*d* are provided on an annular metal flat plate of support member 60. These protrusions are each constituted by a curved surface and have an identical radius. The respective protrusions are disposed such that a line connecting vertexes of the upper protrusions and a line connecting vertexes of the lower protrusions cross each other at right angles.

As illustrated in FIG. 20, support member 60, lower race 58, ball 54, and upper race 52 are disposed on top of one another on thrust surface 48 in this order in contact with each other to constitute thrust ball bearing 64. Flange portion 62 of shaft 18 is seated on an upper surface of upper race 52.

Lower protrusions 60*a*, 60*b* of support member 60 are in linear contact with thrust surface 48, while upper protrusions 60*c*, 60*d* are in linear contact with lower race 58. Thrust ball bearing 64 is a rolling bearing which houses ball 54 that rolls in point contact with upper race 52 and lower race 58, and therefore reduces friction of rotation while supporting a load applied in a vertical direction such as weights of shaft 18 and rotor 16.

Accordingly, cylinder block 24 has a vertical space sufficient to accommodate upper race 52, ball 54, lower race 58, and support member 60 disposed on top of one another in the vertical direction on the outer circumferential side of tubular extension portion 50.

Operation of the sealed compressor thus constructed is hereinafter described.

Thrust ball bearing 64 generates small friction in comparison with a sliding bearing described in PTL 1. Accordingly, the use of thrust ball bearing 64 is increasing in recent years for the purpose of improvement of efficiency. On the other hand, ball 54 in point contact with upper race 52 and lower race 58 generates extremely high contact pressure at a contact point. There is even a possibility of plastic deformation when a contact load increases several times. It is therefore needed to avoid an excessively heavy load applied locally. The sealed compressor described in PTL 2 is provided with support member 60 for this purpose.

Operation of support member 60 is hereinafter described with reference to FIGS. 22A, 22B.

According to a cantilevered bearing structure, shaft 18 comes into a state slightly inclined within a range of a clearance between main shaft portion 20 and a main bearing (not shown) when a compressive load is applied.

When shaft 18 is inclined by the compressive load as illustrated in FIG. 22B from a normal state illustrated in FIG. 22A, support member 60 disposed between thrust surface 48 and lower race 58 is inclined accordingly to maintain positions of upper race 52 and lower race 58 in parallel with each other.

A contact load between ball 54 and upper and lower races 52 and 58 is equalized by an effect of an alignment function of support member 60 for maintaining upper race 52 and lower race 58 in parallel with each other. Accordingly, shortening of life as a result of a large load applied to a part of balls 54 is avoidable.

According to the conventional structure, however, length L of main bearing 26 decreases particularly when sealed container 2 of the sealed compressor has a small overall height. In this case, at least a half of main bearing 26 is accommodated in rotor 16 due to reduction of a shrink-fit width of rotor 16. Furthermore, the upper surface of rotor 16 and support portion 27 of the cylinder block are disposed close to each other. In addition, reduction of wall thickness D of support portion 27 around main bearing 26 of cylinder block 24 is needed.

In this case, an angle of main shaft portion 20 of shaft 18 at the maximum inclination within main bearing 26 increases as length L of main bearing 26 decreases. Moreover, the thrust bearing which includes support member 60 for absorbing the inclination of shaft 18 brings ball 54 into uniform contact with upper race 52 and lower race 58, and therefore does not generate reaction force in a direction for restoring the inclination of shaft 18. Accordingly, shaft 18 is more easily inclined.

When the inclination of shaft 18 increases, inclination of piston 28 connected with eccentric shaft portion 22 via connection portion 36 increases within cylinder 30. In this condition, refrigerant gas easily leaks from compression chamber 34 through a clearance between piston 28 and cylinder 30, and causes deterioration of compression performance.

Moreover, the overall height of thrust bearing 64 increases by the thickness of support member 60 when thrust bearing 64 includes support member 60. This configuration requires a vertically wide space above support portion 27. For meeting this requirement, reduction of wall thickness D of support portion 27 is necessary. When wall thickness D is reduced, rigidity of cylinder block 24 lowers and main bearing 26 is easily deformed by the compressive load. In case of deformation of main bearing 26, the inclination of shaft 18 increases; wherefore the inclination of piston 28 increases accordingly. As a result, a problem of performance deterioration may occur.

The inclination of shaft 18 increases when rigidity of cylinder block 24 including support portion 27 lowers and main bearing 26 is easily deformed by the compressive load. In this case, a thickness of an oil film between main shaft portion 20 and main bearing 26 receiving the compressive load locally decreases; leading to a mixed lubrication state and increase in bearing loss.

Provided according to the present invention is a sealed compressor capable of achieving improvement of performance by reducing inclination of a piston produced by inclination of a shaft to decrease leakage of refrigerant gas from a compression chamber.

Further provided according to the present invention is a sealed compressor capable of achieving reduction of an overall height and improvement of efficiency.

CITATION LIST

Patent Literature

PTL 1: Unexamined Japanese Patent Publication No. 2007-132261

PTL 2: Japanese Translation of PCT Publication No. 2005-500476

SUMMARY OF THE INVENTION

A sealed compressor according to the present invention comprises a sealed container that stores lubricating oil, and houses an electric unit equipped with a stator and a rotor, and a compression unit disposed above the electric unit. The compression unit includes a shaft that includes a main shaft portion to which the rotor is fixed, and an eccentric shaft portion, a cylinder block that includes a cylinder. The compression unit further includes a piston reciprocatively inserted into the cylinder, a connection portion that connects the piston and the eccentric shaft portion. The compression unit further includes a main bearing provided in the cylinder block and supporting a load applied to the main shaft portion of the shaft in a radial direction, and a thrust bearing that supports a load of the shaft in a vertical direction. The thrust bearing is a rolling bearing that includes an upper race in contact with a flange portion of the shaft, a lower race in contact with a thrust surface of the cylinder block, and a rolling element in contact with the upper race and the lower race. An overall height of the sealed container is sized not to exceed a length six times larger than a diameter of the piston.

According to this structure, the overall height of the sealed container is set to a small length not exceeding a length six times larger than the diameter of the piston. In this case, the length of the main bearing is small; wherefore the main shaft portion of the shaft easily inclines within the main bearing as a result of inclination of the shaft within the main bearing under application of a compressive load, for example. However, reaction force is generated in the thrust bearing in a direction for reducing the inclination of the main shaft portion. Accordingly, the inclination of the shaft decreases. This decrease in the inclination of the shaft also decreases inclination of the piston within the cylinder, thereby reducing leakage of refrigerant gas from a compression chamber through a clearance between the piston and the cylinder.

Moreover, the following advantageous effects are offered by the sealed compressor which includes the sealed container whose overall height is set to a small length not exceeding a length six times larger than the diameter of the piston, and adopts the thrust bearing constituted by the rolling bearing for reduction of the wall thickness of a support portion around the main bearing of the cylinder block. The thrust bearing constituted by the rolling element, the upper race in contact with the flange portion of the shaft, and the lower race in contact with the thrust surface of the cylinder block has a small overall height. In this case, the wall thickness of the support portion of the cylinder block is allowed to increase and avoid lowering of rigidity. Accordingly, inclination of the shaft as a result of deformation of the main bearing caused by a compressive load decreases; wherefore inclination of the piston within the cylinder also decreases. This inclination decrease reduces leakage of refrigerant gas from the compression chamber through the clearance between the piston and the cylinder.

According to the sealed compressor of the present invention, the thrust bearing for supporting the load of the shaft in the vertical direction is constituted by the rolling bearing that includes the upper race in contact with the flange portion of the shaft, the lower race in contact with the thrust surface of the cylinder block, and the rolling element in contact with the upper race and the lower race. The electric unit is a surface magnet type electric motor which includes a permanent magnet on the surface of the rotor.

This structure eliminates a support member provided on the thrust bearing. In this case, the overall height of the thrust bearing is allowed to decrease by an amount corresponding to a thickness of the support member; wherefore the wall thickness of the cylinder block around the main bearing is allowed to increase. Moreover, an amount of effective magnetic flux on the surface of the rotor increases in the case of the rotor of the surface magnet type electric motor which includes a permanent magnet disposed on the surface of the rotor. In this case, an overhang portion is allowed to decrease in comparison with a rotor of an embedded magnet type electric motor. Accordingly, the height of the rotor is allowed to decrease.

A clearance space between the cylinder block and the rotor therefore increases even in the case of the sealed compressor that includes the sealed container having a small overall height. As a result, the wall thickness of the cylinder block around the main bearing is allowed to increase to raise rigidity of the main bearing.

Accordingly, deformation of the main bearing caused by the compressive load applied to the shaft decreases; wherefore inclination of the shaft and inclination of the piston are simultaneously reduced.

The sealed compressor according to the present invention includes the thrust ball bearing, and the electric unit constituted by an outer rotor motor.

The thrust ball bearing causes less friction than a sliding bearing; wherefore a sliding loss generated at a thrust portion of a crank shaft decreases. Moreover, the electric unit constituted by an outer rotor motor can have an extended bearing portion that reaches a position of fixation between the main shaft and the rotor. In this case, the length of the bearing portion is allowed to increase to the maximum length when the fixing portion between the main shaft and the rotor is located below the stator. This structure decreases the maximum inclination angle of the crank shaft within the bearing portion, thereby reducing inclination of the piston within a cylinder bore. Accordingly, twisting between the piston and the cylinder bore decreases.

DESCRIPTION OF EMBODIMENTS

Exemplary embodiments according to the present invention are hereinafter described with reference to the drawings.

First Exemplary Embodiment

Figure 1:
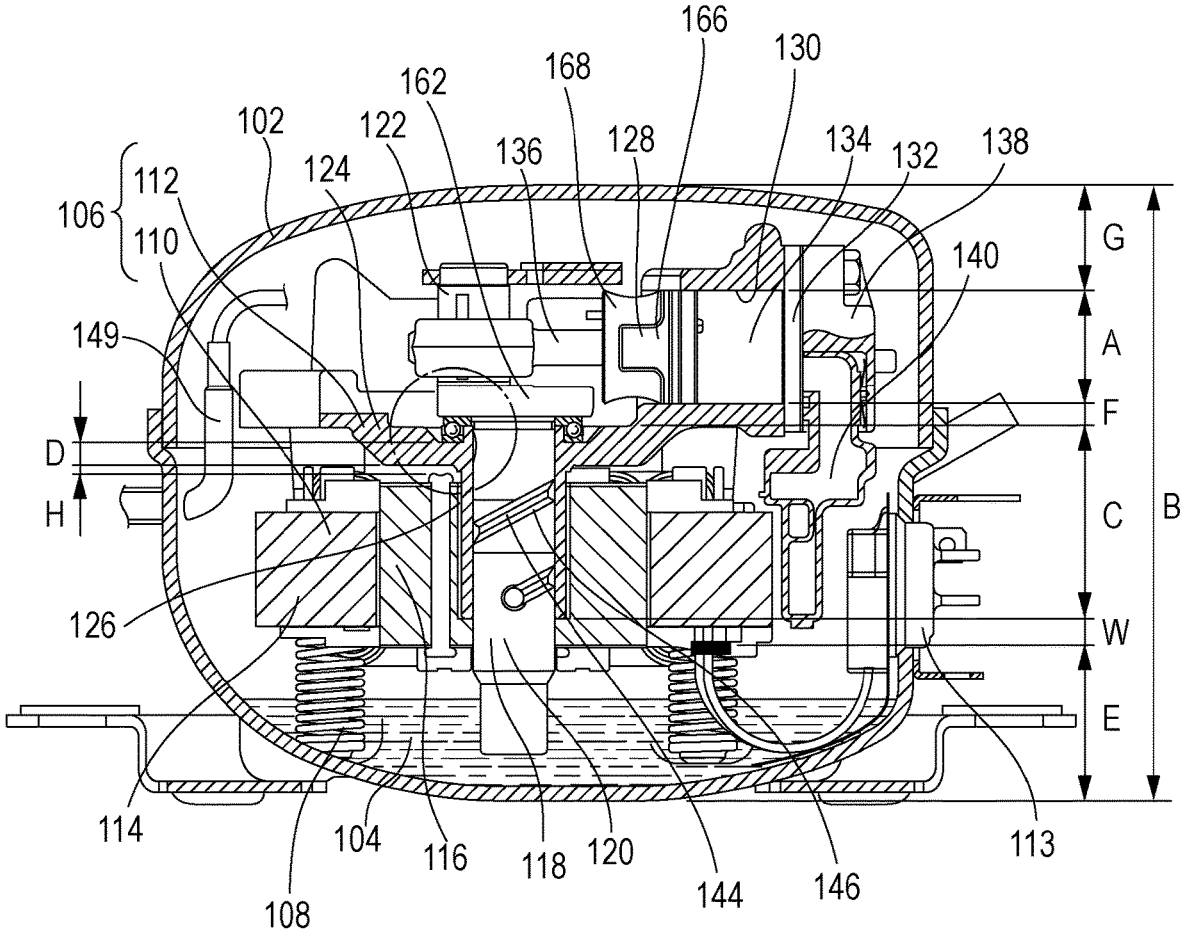
FIG. 1 is a vertical cross-sectional view of a sealed compressor according to a first exemplary embodiment of the present invention.
Figure 2:
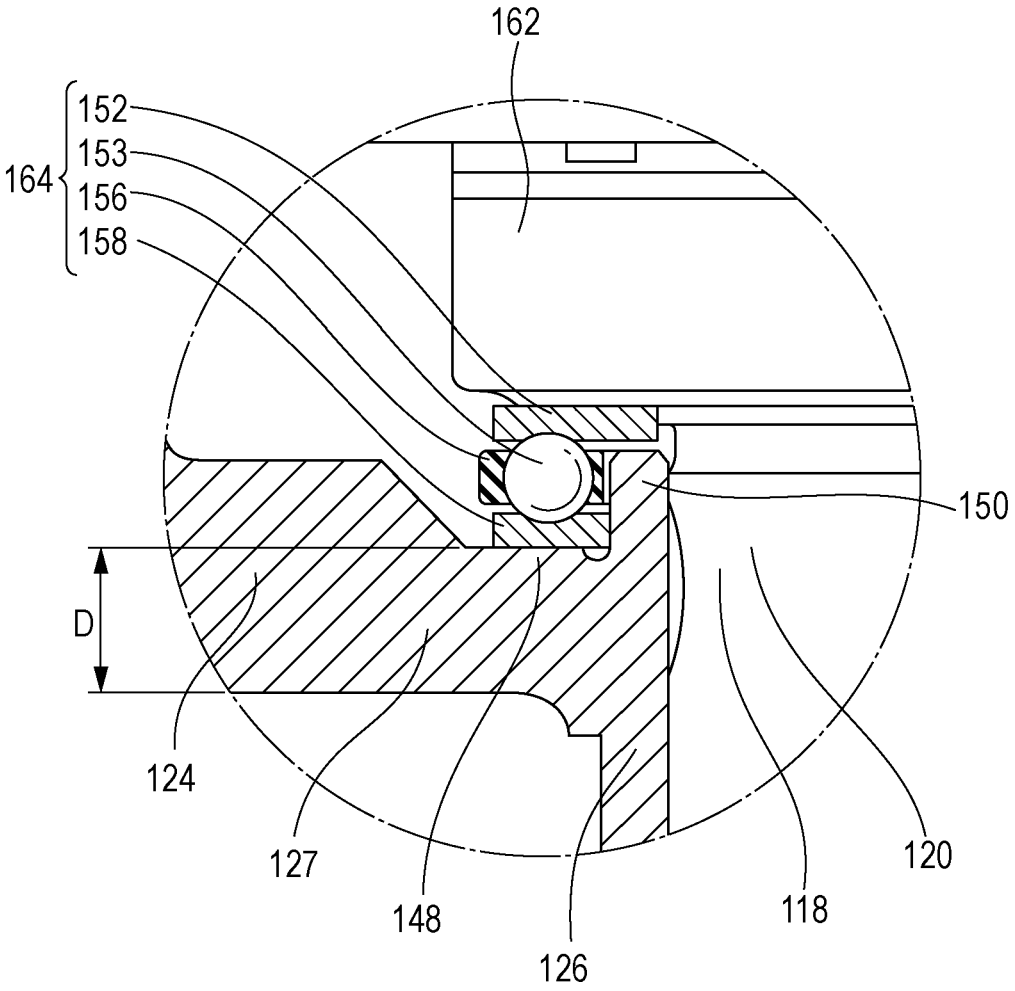
FIG. 2 is an enlarged view illustrating a main part of a thrust bearing included in the sealed compressor according to the first exemplary embodiment of the present invention.
Figure 3A:
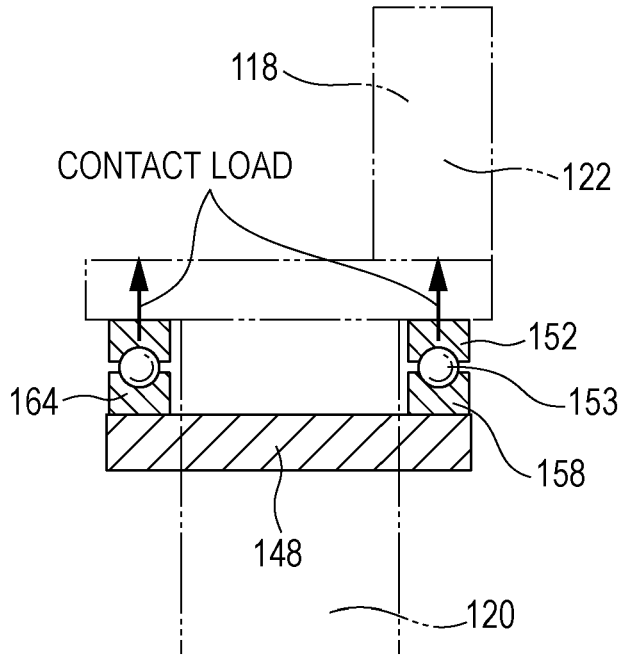
FIG. 3A is a schematic view illustrating a normal state of a thrust ball bearing of the sealed compressor according to the first exemplary embodiment of the present invention.
Figure 3B:
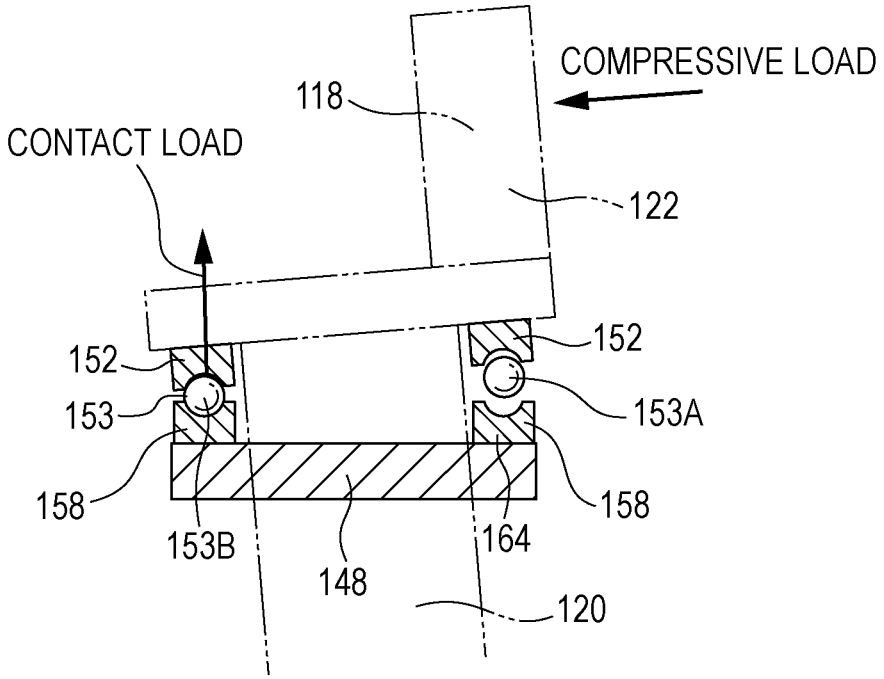
FIG. 3B is a schematic view illustrating an inclined state of a shaft inclined by a compressive load of the thrust ball bearing of the sealed compressor according to the first exemplary embodiment of the present invention.

FIG. 1 is a vertical cross-sectional view of a sealed compressor according to a first exemplary embodiment of the present invention. FIG. 2 is an enlarged view illustrating a main part of a thrust bearing included in the sealed compressor according to the first exemplary embodiment of the present invention. FIGS. 3A, 3B are schematic views illustrating a condition of the thrust bearing in an inclined state of a shaft of the sealed compressor according to the first exemplary embodiment of the present invention.

As illustrated in FIGS. 1, 2, lubricating oil 104 is stored in an inner bottom portion of sealed container 102. Compressor body 106 is internally suspended in sealed container 102 via suspension spring 108. Sealed container 102 is filled with R600a (isobutane) which is refrigerant gas having a low warming potential value.

Compressor body 106 includes electric unit 110, and compression unit 112 driven by electric unit 110. Power supply terminal 113 is attached to sealed container 102 to supply power to electric unit 110.

Electric unit 110 is initially described.

Electric unit 110 is a salient pole concentrated winding type DC brushless motor including stator 114 and rotor 116. Stator 114 is constituted by an iron core housing lamination of steel plates, and winding (not shown) directly wound around a plurality of magnetic pole teeth of the iron core via insulating material. Rotor 116 is disposed radially inside stator 114, and houses a permanent magnet (not shown).

A length of an iron core of rotor 116 is larger than a length of the iron core of stator 114 in a height direction. More specifically, the height of stator 114 is 26 mm, while the height of rotor 116 is 36 mm. Rotor 116 protrudes upward and downward from stator 114 by approximately 5 mm for each.

The winding of stator 114 passes through power supply terminal 113, and connects via a lead to an inverter circuit (not shown) disposed outside the sealed compressor. Electric unit 110 is driven at a plurality of rotational frequencies including rotational frequencies higher than 60 Hz corresponding to a commercial power supply frequency.

Compression unit 112 is hereinafter described.

Compression unit 112 is disposed above electric unit 110.

Shaft 118 constituting compression unit 112 includes main shaft portion 120, and eccentric shaft portion 122 which rises upward from flange portion 162 formed at an upper end of main shaft portion 120, and extends in parallel with main shaft portion 120. Rotor 116 is fixed to main shaft portion 120 by shrink fitting.

Cylinder block 124 includes main bearing 126 having a cylindrical inner surface. At least a half of an overall length of main bearing 126 is inserted into a bore formed at a center of rotor 116, and overlapped with rotor 116. In this condition, main shaft portion 120 is rotatably inserted into main bearing 126 to support shaft 118. Compression unit 112 has a cantilevered bearing structure which supports a load applied to eccentric shaft portion 122 by using main shaft portion 120 and main bearing 126 disposed below eccentric shaft portion 122.

Cylinder block 124 includes cylinder 130 constituted by a cylindrical bore. Piston 128 is reciprocatively inserted into cylinder 130.

A head end portion of an outer circumferential surface of piston 128 forms sliding portion 166 which faces an inner circumferential surface of cylinder 130 with a small clearance formed between piston 128 and cylinder 130. Sliding portion 166 maintains airtightness, and supports a load. A tail end portion of the outer circumferential surface of piston 128 forms non-sliding portion 168 which has a smaller radius than a radius of sliding portion 166 by approximately 0.3 mm. The tail end portion produces a large clearance from the inner circumferential surface of cylinder 130, and generates small viscous friction. Sliding portion 166 is constituted by an annular tip portion and a portion extended to both sides in a lateral direction. Non-sliding portion 168 is constituted by upper and lower outer circumferential rear surfaces of piston 128.

Connection portion 136 connects eccentric shaft portion 122 and piston 128 by engagement of holes formed at one and the other ends of connection portion 136 with a piston pin (not shown) attached to piston 128 and eccentric shaft portion 122, respectively.

Valve plate 132 is attached to an end surface of cylinder 130 so that compression chamber 134 is constituted by valve plate 132, cylinder 130, and piston 128. Cylinder head 138 is further fixed to cover and cap valve plate 132. Suction muffler 140 for forming a muffled inner space is molded from resin such as polybutylene terephthalate (PBT), and attached to cylinder head 138.

A lower end of main shaft portion 120 of shaft 118 is immersed in lubricating oil 104 stored in the inner bottom portion of sealed container 102 to constitute oil supply mechanism 146. Oil supply mechanism 146 includes spiral groove 144 formed in an external surface of main shaft portion 120 and extended from the lower end to the upper end of shaft 118.

Main bearing 126 includes thrust surface 148 corresponding to a flat surface portion perpendicular to a shaft center, and tubular extension portion 150 extended upward from thrust surface 148 and having an inner surface which faces main shaft portion 120. Lower race 158 is disposed above thrust surface 148 and radially outside tubular extension portion 150. Rolling elements 153 constituted by balls, and retainer 156 are disposed above lower race 158. Upper race 152 is further disposed above rolling elements 153 and tubular extension portion 150.

Retainer 156 is an annular flat plate made of resin, and includes a plurality of holes in each of which rolling element 153 constituted by a ball is accommodated. Retainer 156 is freely fitted to the radially outside of tubular extension portion 150 so that retainer 156 and tubular extension portion 150 are freely rotatable relative to each other.

Each of upper race 152 and lower race 158 is an annular flat plate made of metal, and includes a groove formed along a track in contact with balls of rolling elements 153, and sized to be substantially equivalent to each radius of rolling elements 153.

Lower race 158, rolling elements 153, and upper race 152 are disposed on top of one another on thrust surface 148 in this order in contact with each other to constitute thrust bearing 164. Flange portion 162 of shaft 118 is seated on an upper surface of upper race 152.

Dimensional ratios of respective units are hereinafter described.

Dimension B corresponding to an overall height of sealed container 102 is sized not to exceed a length six times larger than dimension A corresponding to a diameter of piston 128. More specifically, dimension A corresponding to the diameter of piston 128 is 25.4 mm, while dimension B corresponding to the overall height of sealed container is 140 mm. Accordingly, a ratio of (dimension B as the overall height)/(dimension A as the diameter) is 5.5 which is not greater than 6.

Length C of main bearing 126 is 45 mm. A ratio of (dimension C as the length)/(dimension A as the diameter) is 1.8 which lies in a range from 1.5 to 2.

Dimension E corresponds to a height from a lower end of rotor 116 to a lower end of sealed container 102, and includes a clearance between rotor 116 and lubricating oil 104, a depth of lubricating oil 104, and a plate thickness of the bottom portion of sealed container 102. A certain width of the clearance between rotor 116 and lubricating oil 104 is needed to avoid stirring of lubricating oil 104 by rotor 116 even when lubricating oil 104 contains melted refrigerant gas at a startup. In addition, an appropriate amount of lubricating oil 104 is required in view of assurance of reliability; wherefore dimension E needs to be set to a height approximately 1.5 times larger than dimension A of piston 128.

Height F from cylinder 130 to an upper end of main bearing 126 is set to a dimension approximately 0.2 times larger than diameter A of piston 128.

Height G from an upper end of an inner circumferential surface of cylinder 130 to an upper end of sealed container 102 includes a wall thickness of cylinder block 124, a clearance between sealed container 102 and compressor body 106 internally suspended within sealed container 102, and a plate thickness of a top surface of sealed container 102. A certain dimension of the wall thickness of cylinder block 124 is required to secure airtightness of compression chamber 134. Moreover, a certain clearance is needed between sealed container 102 and compressor body 106 to avoid generation of abnormal noise as a result of collision between internally suspended compressor body 106 and sealed container 102 during operation. Accordingly, height G is required to have a height substantially equivalent to dimension A of piston 128.

A portion of rotor 116 corresponding to width W for shrink fitting is fixed to main shaft portion 120 by shrink fitting.

Overall height B of sealed container 102 is a sum of diameter A, length C, height E, height F, height G, and width W.

Overall height B of sealed container 102 can be sized small enough not to exceed a length six times larger than diameter A when shrink-fit width W is set smaller than a length 0.5 times larger than diameter A of piston 128 to accommodate at least the half of the length of main bearing 126 within rotor 116.

When at least the half of the overall length of main bearing 126 is accommodated in the bore at the center of rotor 116, rotor 116 is close to support portion 127 of cylinder block 124. Accordingly, thickness D of support portion 127 of cylinder block 124 is reduced to secure a sufficient clearance dimension H between the upper end of rotor 116 and support portion 127.

This positioning of compression unit 112 and electric unit 110 close to each other also contributes to reduction of the overall height of sealed container 102.

Operation and effect of the sealed compressor constructed as above is hereinafter described.

When electric unit 110 is energized via power supply terminal 113, rotor 116 is rotated together with shaft 118 by a magnetic field generated in stator 114. Eccentric rotation of eccentric shaft portion 122 produced by rotation of main shaft portion 120 is transmitted to connection portion 136, and converted into movement for reciprocating piston 128 within cylinder 130. This reciprocating movement changes a volume of compression chamber 134, and causes compression operation of sucking refrigerant gas from sealed container 102 into compression chamber 134 to compress the refrigerant gas.

In this suction step during the compression operation, the refrigerant gas within sealed container 102 is intermittently sucked into compression chamber 134 via suction muffler 140, and compressed in compression chamber 134. The resultant high-temperature and high-pressure refrigerant gas passes through discharge piping 149 and the like, and travels toward a freezing cycle (not shown).

Lubricating oil 104 stored in the bottom portion of sealed container 102 is supplied upward from the lower end of shaft 118, and scattered from a tip of eccentric shaft portion 122 by operation of oil supply mechanism 146 performed in accordance with rotation of shaft 118.

During the compression operation, a compressive load is applied to eccentric shaft portion 122 of shaft 118 from piston 128 via connection portion 136. As a result, shaft 118 is slightly inclined within the clearance between main shaft portion 120 and main bearing 126.

FIGS. 3A, 3B schematically illustrate thrust bearing 164 at the time of inclination of shaft 118 by the compressive load.

In a state of an absence of the compressive load as illustrated in FIG. 3A, a load in the vertical direction such as a weight of shaft 118 is uniformly supported via contact points between balls of respective rolling elements 153 and upper and lower races 152 and 158. Accordingly, respective contact loads are small.

On the other hand, when shaft 118 is inclined by an effect of anticlockwise moment generated by the compressive load as illustrated in FIG. 3B, rolling elements 153A corresponding to right balls are separated from upper and lower races 152 and 158. In this condition, no contact load is produced between the right balls and upper and lower races 152 and 158. However, large contact loads are applied between rolling elements 153B corresponding to left balls and upper and lower races 152 and 158.

In this case, clockwise moment in the direction opposite to the anticlockwise moment generated by the compressive load is applied to shaft 118 by the contact loads. Accordingly, inclination of shaft 118 caused by the compressive load decreases.

As a result, inclination of piston 128 connected with shaft 118 via connection portion 136 also decreases, whereby deterioration of performance and efficiency caused by leakage of refrigerant gas from compression chamber 134 through the clearance between piston 128 and cylinder 130 is avoidable.

When contact between balls of rolling elements 153 and upper and lower races 152 and 158 are non-uniform, large contact loads are applied to particular rolling elements 153. However, the circular-arc-shaped grooves formed in upper and lower races 152 and 158 produce substantially linear contact between rolling elements 153 and upper and lower races 152 and 158, in which condition a contact area therebetween microscopically increases. Accordingly, durability of rolling elements 153 is securable.

Furthermore, the grooves thus formed decrease contact pressure at the contact points between balls of rolling elements 153 and upper and lower races 152 and 158. In this case, damage to rolling elements 153 and upper and lower races 152 and 158 is avoidable even when impact is given at the time of transfer of the sealed compressor. Accordingly, reliability of the sealed compressor improves.

When overall height B of sealed container 102 is set to a small length not exceeding a length six times larger than diameter A of piston 128 to decrease the overall height of the sealed compressor, the length of main bearing 126 is small as a consequence. Accordingly, when the clearance between main bearing 126 and main shaft portion 120 is unchanged, possible inclination produced within the clearance increases.

According to this exemplary embodiment, however, this inclination is reduced by the operation of thrust bearing 164 illustrated in FIG. 3B. Particularly when the length of main bearing 126 is reduced to a small length not exceeding a length twice as large as the diameter of piston 128, the effect of inclination reduction offered by thrust bearing 164 is remarkable.

Figure 4:
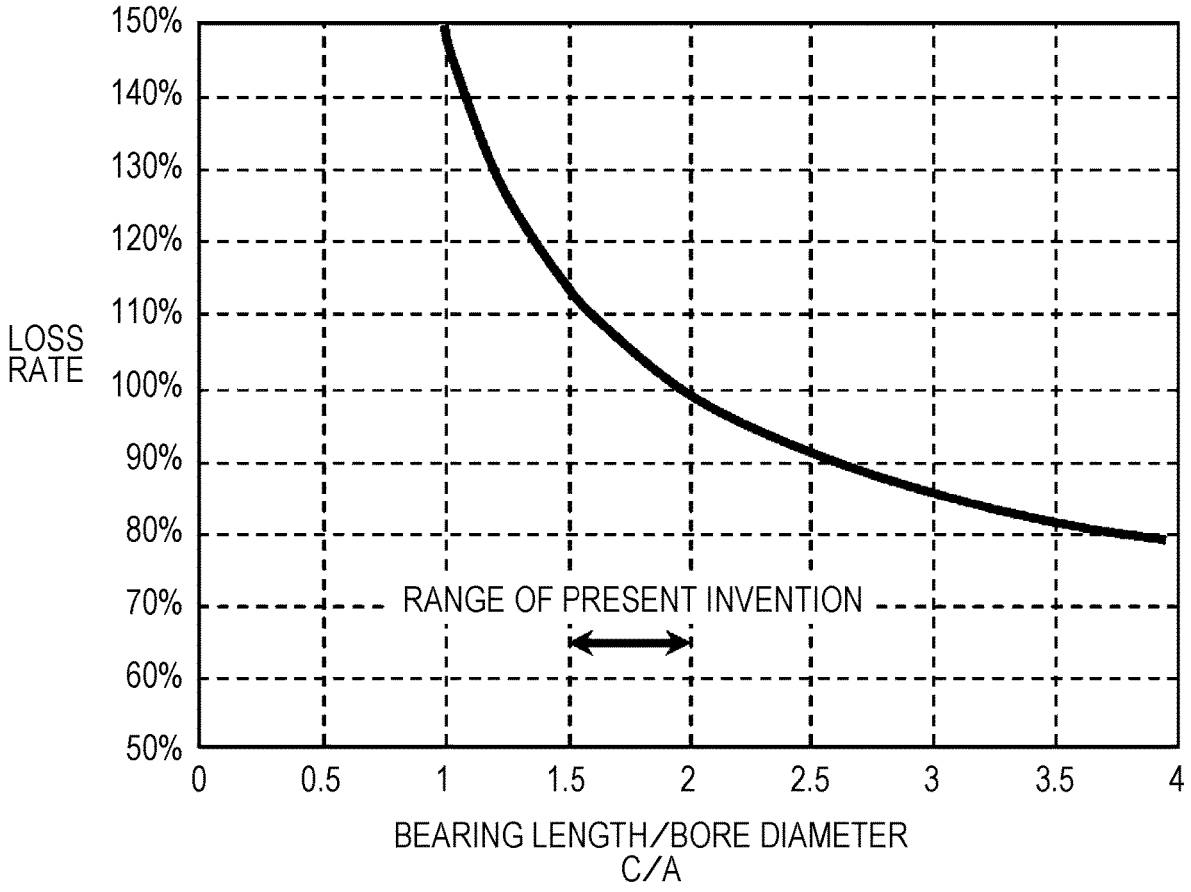
FIG. 4 is a characteristic view showing changes of a loss rate with changes of a bearing length of the sealed compressor according to the first exemplary embodiment of the present invention.

FIG. 4 shows a sliding loss along with a change of the bearing length of main bearing 126, which is calculated based on theoretical calculation.

In this figure, a horizontal axis indicates a ratio of length C of main bearing 126 to diameter A of piston 128, i.e., (length C)/(diameter A). On the other hand, a vertical axis indicates a sliding loss on the assumption that a loss of 100% is generated when (length C)/(diameter A) is 2.

As can be seen from FIG. 4, a load applied by moment decreases as the value (length C)/(diameter A) increases, i.e., the length of the main bearing increases. In this case, the sliding loss decreases. On the other hand, the inclination increases as the value (length C)/(diameter A) decreases. For example, in a state that (length C)/(diameter A) is doubled from 2 to 4 to set the length of the main bearing to a twice larger length, the loss rate changes from 100% to 80%; wherefore the loss decreases only by approximately 20%. On the other hand, when the value (length C)/(diameter A) is halved from 2 to 1, the loss rate changes from 100% to 150%; wherefore the loss increases by approximately 50%.

As apparent from above, the sliding loss does not greatly decrease even by extreme elongation of the main bearing. On the other hand, the sliding loss drastically increases when the main bearing is extremely shortened. Accordingly, it is preferable that the value (length C)/(diameter A) is set to a value larger than 1.5 in view of reduction of the sliding loss. However, the shortest possible main bearing is desirable in view of decrease in the overall height of the sealed container of the sealed compressor. In consideration of these points, the value (length C)/(diameter A) set within a range from 1.5 to 2.0 contributes to reduction in the sliding loss as well as reduction of the overall height of the sealed container for improvement of efficiency of the sealed compressor.

Moreover, when the height of stator 114 is reduced to a length smaller than the height of rotor 116, a support surface of suspension spring 108 on a lower surface of stator 114 can be positioned above the lower end of rotor 116. Accordingly, the overall height of sealed container 102 of the sealed compressor further decreases.

On the other hand, in the case of the layout which decreases the height of stator 114 to a length smaller than the height of rotor 116, the upper end of rotor 116 is positioned higher than the upper end of stator 114. Accordingly, for further reduction of the overall height of sealed container 102 of the sealed compressor, thickness D of support portion 127 around main bearing 126 of cylinder block 124 needs to decrease. In this case, rigidity of cylinder block 124 easily lowers by reduction of thickness D.

Particularly when thrust bearing 164 is constituted by a rolling bearing for higher efficiency, a vertical space is required to accommodate thrust bearing 164. In this case, further reduction of thickness D of support portion 127 is required.

According to this exemplary embodiment, therefore, use of a support member conventionally equipped is eliminated. Instead, there is provided thrust bearing 164 which includes rolling elements 153 constituted by balls, upper race 152 in contact with flange portion 162 of shaft 118, and lower race 158 in contact with thrust surface 148 of cylinder block 124. According to this structure, the overall height of thrust bearing 164 is reduced; wherefore the constituents can be assembled without reduction of thickness D of support portion 127. In this case, rigidity of support portion 127 of cylinder block 124 does not lower.

As a result, inclination of shaft 118 produced by deformation of main bearing 126 by a compressive load decreases; wherefore inclination of piston 128 within cylinder 130 decreases. Accordingly, efficiency of the sealed compressor improves by reduction of leakage of refrigerant gas from compression chamber 134 through the clearance between piston 128 and cylinder 130.

When the main bearing 126 side on a rear end of piston 128 constitutes non-sliding portion 168 as in this exemplary embodiment, the length of piston 128 is substantially small. This structure decreases regulation of the inclination of piston 128 within cylinder 130, and allows easy inclination of piston 128. As a result, performance easily deteriorates due to leakage of refrigerant gas from compression chamber 134. According to the example illustrated in FIG. 3B, however, the operation of thrust bearing 164 reduces inclination of piston 128, thereby decreasing leakage of the refrigerant gas from compression chamber 134 through the clearance between piston 128 and cylinder 130, and improving performance accordingly.

Furthermore, the grooves are formed in upper race 152 and lower race 158 of thrust bearing 164 along the tracks in contact with balls of rolling elements 153. In this case, rolling elements 153 are pressed against side surfaces of the grooves of upper race 152 and lower race 158 by centrifugal force acting on the balls of rolling elements 153 even at a high rotational frequency exceeding a commercial frequency of 60 Hz. Accordingly, damage caused by a slip of rolling elements 153 is avoidable; wherefore reliability of the sealed compressor improves.

According to this exemplary embodiment, rolling elements 153 are constituted by balls. However, rolling elements 153 may be rollers instead of balls. In the case of rolling elements 153 constituted by rollers, contact portions of rollers produce linear contact, and therefore decrease contact pressure even when no grooves are formed in upper race 152 and lower race 158. Accordingly, damage to rolling elements 153 and upper and lower races 152 and 158 is avoidable even when impact is given during transfer of the sealed compressor. As a result, reliability of the sealed compressor improves.

Second Exemplary Embodiment

Figure 5:
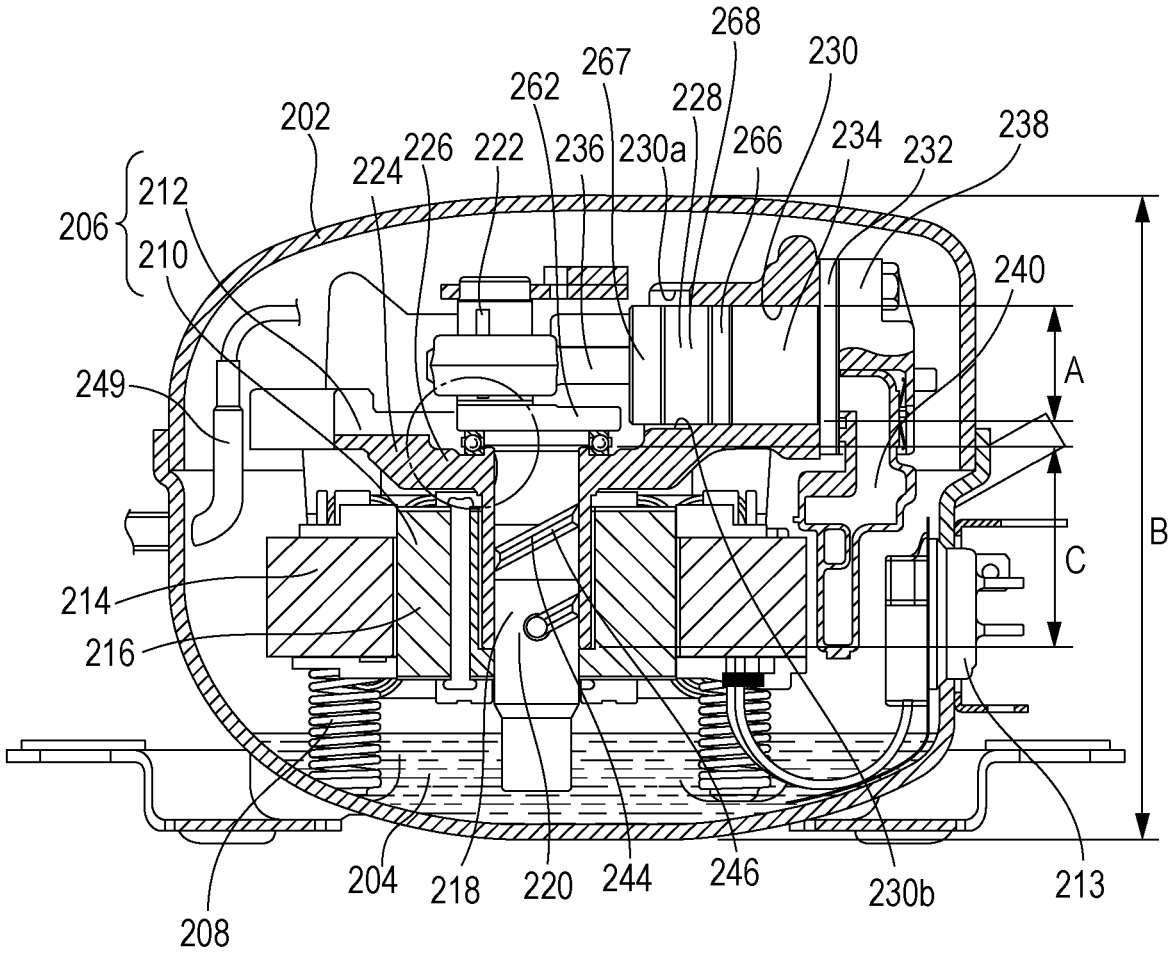
FIG. 5 is a vertical cross-sectional view of a sealed compressor according to a second exemplary embodiment of the present invention.
Figure 6:
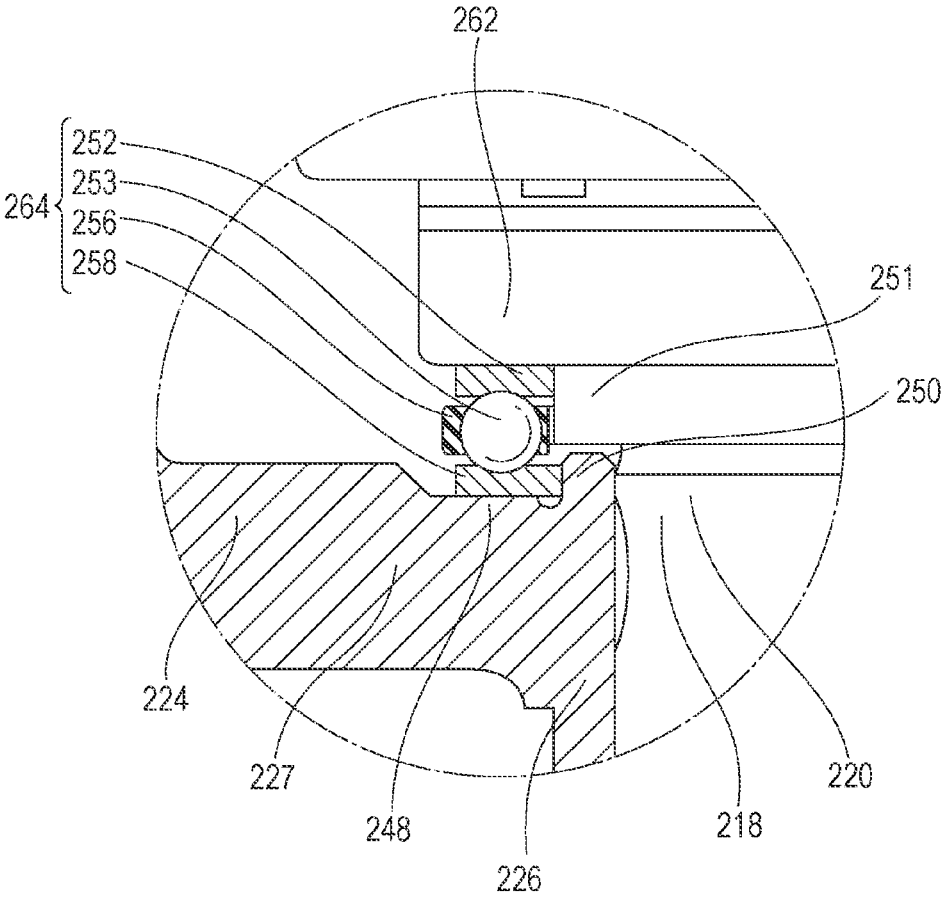
FIG. 6 is an enlarged view illustrating a main part of a thrust bearing included in the sealed compressor according to the second exemplary embodiment of the present invention.

FIG. 5 is a vertical cross-sectional view of a sealed compressor according to a second exemplary embodiment of the present invention. FIG. 6 is an enlarged view illustrating a main part of a thrust bearing included in the sealed compressor according to the second exemplary embodiment of the present invention.

As illustrated in FIGS. 5, 6, lubricating oil 204 is stored in an inner bottom portion of sealed container 202. Compressor body 206 is internally suspended within sealed container 202 via suspension spring 208. Sealed container 202 is filled with R600a (isobutane) which is refrigerant gas having a low warming potential value.

Compressor body 206 includes electric unit 210, and compression unit 212 driven by electric unit 210. Power supply terminal 213 is attached to sealed container 202 to supply power to electric unit 210.

Electric unit 210 is initially described.

Electric unit 210 is a salient pole concentrated winding type DC brushless motor including stator 214 and rotor 216. Stator 214 is constituted by an iron core housing lamination of steel plates, and winding (not shown) directly wound around a plurality of magnetic pole teeth of the iron core via insulating material. Rotor 216 is disposed radially inside stator 214, and houses a permanent magnet (not shown).

A height of an iron core of rotor 216 in a vertical direction is larger than a height of the iron core of stator 214. More specifically, the height of stator 214 is 26 mm, while the height of rotor 216 is 36 mm. Rotor 216 protrudes upward and downward from stator 214 by approximately 5 mm for each.

The winding of stator 214 passes through power supply terminal 213, and connects via a lead to an inverter circuit (not shown) disposed outside the sealed compressor. Electric unit 210 is driven at a plurality of rotational frequencies.

Compression unit 212 is hereinafter described.

Compressor 212 is disposed above electric unit 210.

Shaft 218 constituting compression unit 212 includes main shaft portion 220, and eccentric shaft portion 222 rising upward from an upper end of main shaft portion 220, and extending in parallel with main shaft portion 220. Rotor 216 is fixed to main shaft portion 220 by shrink fitting or other methods. Cylinder block 224 includes main bearing 226 having a cylindrical inner surface. A tip portion of main bearing 226 is inserted into a bore formed at a center of rotor 216. In this condition, main shaft portion 220 is rotatably inserted into main bearing 226 to support shaft 218. Compression unit 212 has a cantilevered bearing structure which supports a load applied to eccentric shaft portion 222 by using main shaft portion 220 and main bearing 226 disposed below eccentric shaft portion 222.

Cylinder block 224 includes cylinder 230 corresponding to a cylindrical bore. Piston 228 is reciprocatively inserted into cylinder 230. Notches 230*a*, 230*b* are formed in upper and lower rear ends of cylinder 230.

A head end portion and a tail end portion of an outer circumferential surface of piston 228 form sliding portions 266, 267, respectively, each of which is disposed with a small clearance left between piston 228 and an inner circumferential surface of cylinder 230. On the other hand, an intermediate portion of piston 228 constitutes non-sliding portion 268 having a radius smaller than each radius of the sliding portions by approximately 0.3 mm.

Connection portion 236 connects eccentric shaft portion 222 and piston 228 by engagement of holes formed at one and the other ends of connection portion 236 with a piston pin (not shown) attached to piston 228 and eccentric shaft portion 222, respectively.

Valve plate 232 is attached to an end surface of cylinder 230 to constitute compression chamber 234 by valve plate 232, cylinder 230, and piston 228. Cylinder head 238 is further fixed to cover and cap valve plate 232. Suction muffler 240 for forming a muffled inner space is molded from resin such as PBT, and attached to cylinder head 238.

A lower end of main shaft portion 220 of shaft 218 is immersed in lubricating oil 204 stored in the inner bottom portion of sealed container 202 to constitute oil supply mechanism 246. Oil supply mechanism 246 includes spiral groove 244 formed in an external surface of main shaft portion 220 and extended from the lower end to the upper end of shaft 218.

Main bearing 226 includes thrust surface 248 corresponding to a flat surface portion perpendicular to a shaft center, and tubular extension portion 250 that is extended upward from thrust surface 248 and has an inner surface which faces main shaft portion 220. Expansion portion 251 having a diameter larger than a diameter of main shaft portion 220 is formed at an upper end of main shaft portion 220 of shaft 218. Lower race 258 is disposed above thrust surface 248 and radially outside tubular extension portion 250. Rolling elements 253 constituted by balls, retainer 256, and upper race 252 are disposed radially outside expansion portion 251.

Retainer 256 is an annular flat plate made of resin, and includes a plurality of holes in each of which rolling element 253 constituted by a ball is accommodated. Retainer 256 is freely fitted to the radially outside of expansion portion 251 so that retainer 256 and expansion portion 251 are freely rotatable relative to each other.

Each of upper race 252 and lower race 258 is an annular flat plate made of metal, and includes a groove formed along a track in contact with balls of rolling elements 253, and sized to be substantially equivalent to each radius of rolling elements 253.

Lower race 258, rolling elements 253, and upper race 252 are disposed on top of one another on thrust surface 248 in this order in contact with each other to constitute thrust bearing 264. Flange portion 262 of shaft 218 is seated on an upper surface of upper race 252.

Overall height B of sealed container 202 is sized not to exceed a length six times larger than diameter A corresponding to a diameter of piston 228. More specifically, diameter A of piston 228 is 25.4 mm, while overall height B of sealed container 202 is 140 mm. Accordingly, a ratio of (overall height B)/(diameter A) is 5.5 which is not greater than 6.

Length C of main bearing 226 is 45 mm. In this case, a ratio of (length C)/(diameter A) is 1.8 which lies in a range from 1.5 to 2.

Operation and effect of the sealed compressor constructed as above is hereinafter described.

When electric unit 210 is energized via power supply terminal 213, rotor 216 is rotated together with shaft 218 by a magnetic field generated in stator 214. Eccentric rotation of eccentric shaft portion 222 produced by rotation of main shaft portion 220 is transmitted to connection portion 236 and converted into movement for reciprocating piston 228 within cylinder 230. This reciprocating movement changes a volume of compression chamber 234, and causes compression operation of sucking refrigerant gas from sealed container 202 into compression chamber 234 to compress the refrigerant gas.

In this suction step during the compression operation, the refrigerant gas within sealed container 202 is intermittently sucked into compression chamber 234 via suction muffler 240, and compressed within compression chamber 234. The resultant high-temperature and high-pressure refrigerant gas passes through discharge piping 249 and the like, and travels toward a freezing cycle (not shown).

Lubricating oil 204 stored in the bottom portion of sealed container 202 is supplied upward from the lower end of shaft 218, and scattered from a tip of eccentric shaft portion 222 by the operation of oil supply mechanism 246 performed in accordance with rotation of shaft 218.

A part of lubricating oil 204 is supplied from an upper end of main bearing 226 to thrust bearing 264. This lubricating oil 204 is supplied to lower race 258 that does not rotate. In this case, lubricating oil 204 adhering to lower race 258 is not immediately scattered by centrifugal force, but remains on a sliding portion. This structure therefore increases a lubricating effect of thrust bearing 264, and improves reliability accordingly.

During the compression operation, a compressive load is applied to eccentric shaft portion 222 of shaft 218 from piston 228 via connection portion 236. As a result, shaft 218 is slightly inclined within a clearance between main shaft portion 220 and main bearing 226.

However, as described in the first exemplary embodiment, restoration force is applied in a direction for reducing the inclination of shaft 218 based on a configuration of thrust bearing 264 not including a support member for absorbing the inclination. As a result, the inclination of shaft 218 decreases, whereby inclination of piston 228 connected to shaft 218 via connection portion 236 decreases. Accordingly, deterioration of performance and efficiency caused by leakage of refrigerant gas from compressor 234 through the clearance between piston 228 and cylinder 230 is avoidable.

According to the sealed compressor which decreases an overall height of sealed container 202 to a small length not exceeding a length six times larger than the piston diameter, a length of main bearing 226 decreases as a consequence. In this case, inclination of main shaft portion 220 within the clearance of main bearing 226 easily increases. According to this exemplary embodiment, however, the inclination of shaft 218 decreases by reaction force applied by thrust bearing 264 in a direction for reducing the inclination of shaft 218. This effect is particularly remarkable when the length of main bearing 226 is set to a small length not exceeding a length twice as large as the diameter of piston 228.

A width for shrink fitting between rotor 216 and main shaft portion 220 is reduced to insert at least a half of the overall length of main bearing 226 into the bore of rotor 216. In this case, the overall height of sealed container 202 is allowed to decrease while securing a sufficient length of main bearing 226. In addition, a height of stator 214 is smaller than a height of rotor 216. In this case, the support surface of suspension spring 208 on the lower surface of stator 214 is positioned at substantially the same level as the lower end of main bearing 226. Accordingly, the height of the sealed compressor further decreases.

On the other hand, this structure raises the position of the upper end of rotor 216, and thus requires reduction of a wall thickness around main bearing 226 of cylinder block 224. When this wall thickness is reduced, rigidity easily lowers. According to this exemplary embodiment, however, the thrust rolling bearing has a smaller height by elimination of the support member. Moreover, only lower race 258 is accommodated in a recess portion radially outside tubular extension portion 250. Tubular extension portion 250 has a small height. Accordingly, the wall thickness of support portion 227 of cylinder block 224 is allowed to increase to secure rigidity of cylinder block 224. As a result, the inclination of shaft 218 decreases; wherefore performance improves by reduction of leakage of refrigerant gas from compression chamber 234.

Notches 230*a*, 230*b* are formed at the rear end of cylinder 230. This structure provides only limited regulation of inclination of piston 228 within cylinder 230. In this case, piston 228 is easily inclined; wherefore performance easily deteriorates due to leakage of refrigerant gas from compression chamber 234. However, this inclination is reducible by providing thrust bearing 264. Accordingly, performance of the sealed compressor of this exemplary embodiment improves.

Third Exemplary Embodiment

Figure 7:
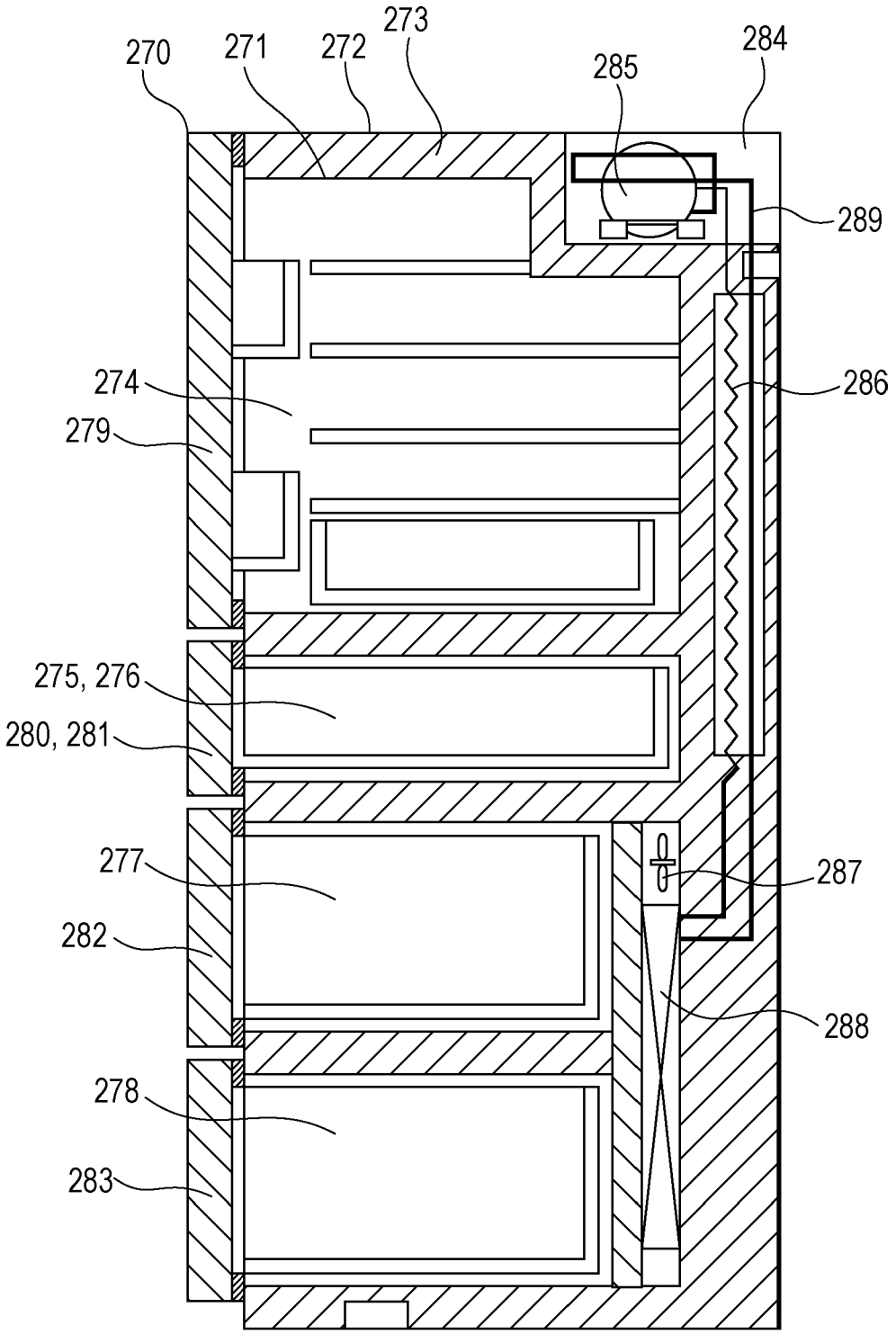
FIG. 7 is a cross-sectional view schematically illustrating a refrigerator according to a third exemplary embodiment of the present invention.

FIG. 7 is a cross-sectional view schematically illustrating a refrigerator according to a third exemplary embodiment of the present invention.

As illustrated in FIG. 7, heat insulating box 270 includes inner box 271 constituted by a vacuum-formed resin body such as ABS (acrylonitrile-butadiene-styrene copolymers), outer box 272 made of metal material such as precoated sheet steel, and insulating walls produced by injecting heat insulator 273 into a space formed between inner box 271 and outer box 272, and foaming heat insulator 273 filled in the space. Heat insulator 273 is constituted by rigid urethane foam, phenolic foam, or styrene foam, for example. It is preferable that foaming material is constituted by hydrocarbon-based cyclopentane in view of global warming prevention.

Heat insulating box 270 is divided into a plurality of heat insulating sections. An upper part of heat insulating box 270 is equipped with a pivoted door, while a lower part of heat insulating box 270 is equipped with drawers. Refrigerating compartment 274 is disposed in the upper part. Below refrigerating compartment 274 are provided drawer-type switching compartment 275 and ice compartment 276 located side by side in a horizontal direction. Below both compartments 275 and 276 is drawer-type vegetable compartment 277. Below vegetable compartment 277 is drawer-type freezing compartment 278.

A heat insulating door is provided via a gasket for each of the heat insulating sections. Refrigerating compartment pivoted door 279 is disposed in the upper part. Below refrigerating compartment pivoted door 279 are switching compartment drawer door 280 and ice compartment drawer door 281. Below both doors 280 and 281 is vegetable compartment drawer door 282. Below vegetable compartment drawer door 282 is freezing compartment drawing door 283.

Outer box 272 of heat insulating box 270 includes recess portion 284 corresponding to a recessed rear top surface.

A freezing cycle is constituted by an annular connection of sealed compressor 285 elastically supported on recess portion 284, a condenser (not shown), capillary 286, a drier (not shown), evaporator 288 disposed on the rear of vegetable compartment 277 and freezing compartment 278, and suction piping 289. Cooling fan 287 is provided in the vicinity of evaporator 288.

Operation and effect of the refrigerator thus constructed are hereinafter described.

Temperature settings and cooling systems of the respective heat insulation sections are initially discussed.

A compartment temperature of refrigerating compartment 274 is generally set within a range from 1° C. to 5° C. above a freezing temperature for refrigerated storage.

A temperature setting of switching compartment 275 is changeable by a user between predetermined temperatures within a range from a freezing compartment temperature zone to a vegetable compartment temperature zone. Ice compartment 276 is an independent ice storage compartment, and includes a not-shown automatic ice making device for automatically producing ice and storing produced ice. A compartment temperature of ice compartment 276 lies in the freezing temperature zone for storing ice. However, this temperature may be set to a freezing temperature in a range from −18° C. to −10° C., a range relatively higher than the freezing temperature zone for the purpose of storing ice only.

A compartment temperature of vegetable compartment 277 is often set in a range from 2° C. to 7° C., a temperature equivalent to or slightly higher than the compartment temperature of refrigerating compartment 274. Leafy vegetables maintain freshness for a longer period as the storage temperature is set to a lower temperature within such a range that the vegetables do not freeze.

A compartment temperature of freezing compartment 278 is generally set in a range from −22° C. to −18° C. for freezing storage. However, this temperature may be set to a lower temperature, such as −30° C. and −25° C., for improvement of freezing storage conditions.

The respective compartments are sectioned by heat insulating walls to efficiently maintain different temperature settings. In this case, heat insulator 273 may be integrally injected and foamed for cost reduction and improvement of heat insulating performance. By injection of heat insulator 273, heat insulating performance increases to approximately twice higher than heat insulating performance of a heat insulating material such as styrene foam. Accordingly, a storage volume is allowed to increase by reduction of a partitioning thickness.

Operation of the freezing cycle is hereinafter described.

Cooling operation is started or stopped based on temperatures set for the refrigerator in accordance with signals generated from a temperature sensor (not shown) and a control board. Sealed compressor 285 performs predetermined compression operation in accordance with instructions of cooling operation. Discharged high-temperature and high-pressure refrigerant gas releases heat, and condenses and liquefies at a condenser (not shown). The refrigerant becomes low-temperature and low-pressure liquefied refrigerant as a result of pressure reduction by capillary 286, and flows to evaporator 288.

The refrigerant gas in evaporator 288 is evaporated and vaporized by heat exchange with air contained in the refrigerator in accordance with operation of cooling fan 287. The low-temperature cool air after the heat exchange is distributed to the respective compartments by using a damper (not shown) or the like to cool the respective compartments.

According to the refrigerator performing the foregoing operation, sealed compressor 285 includes a thrust bearing for supporting a load of a shaft in a vertical direction. The thrust bearing is constituted by a rolling bearing which includes an upper race in contact with a flange portion of the shaft, a lower race in contact with a thrust surface of a cylinder block, and rolling elements in contact with the upper race and the lower race. An overall height of the thrust bearing is sized not to exceed a length six times larger than a piston diameter.

According to this structure, an overall height of the sealed container of sealed compressor 285 decreases. Accordingly, usability of the refrigerator improves by enlargement of an inside volume of the refrigerator.

In addition, the thrust rolling bearing is capable of reducing losses, and generates reaction force in a direction for reducing inclination of the shaft within a main bearing by operation of the thrust bearing at the time of inclination of the shaft by a compressive load, for example. Accordingly, the inclination of the shaft decreases. As a result, inclination of a piston within the cylinder decreases accordingly, in which condition efficiency of the sealed compressor improves by reduction of leakage of refrigerant gas from the compression chamber through a clearance between the piston and the cylinder. Sealed compressor 285 therefore corresponds to the sealed compressor according to the first exemplary embodiment of the present invention.

Fourth Exemplary Embodiment

Figure 8:
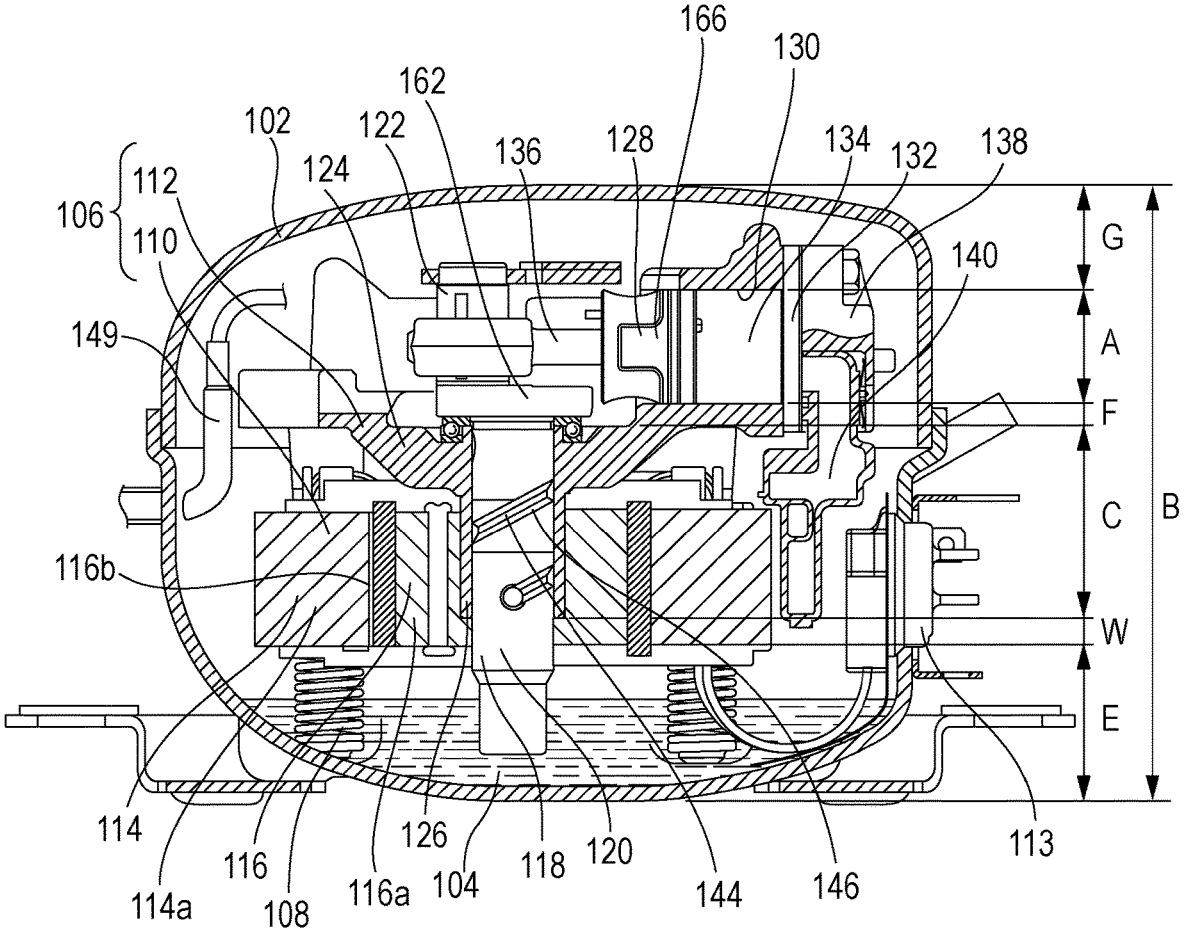
FIG. 8 is a vertical cross-sectional view of a sealed compressor according to a fourth exemplary embodiment of the present invention.
Figure 9:
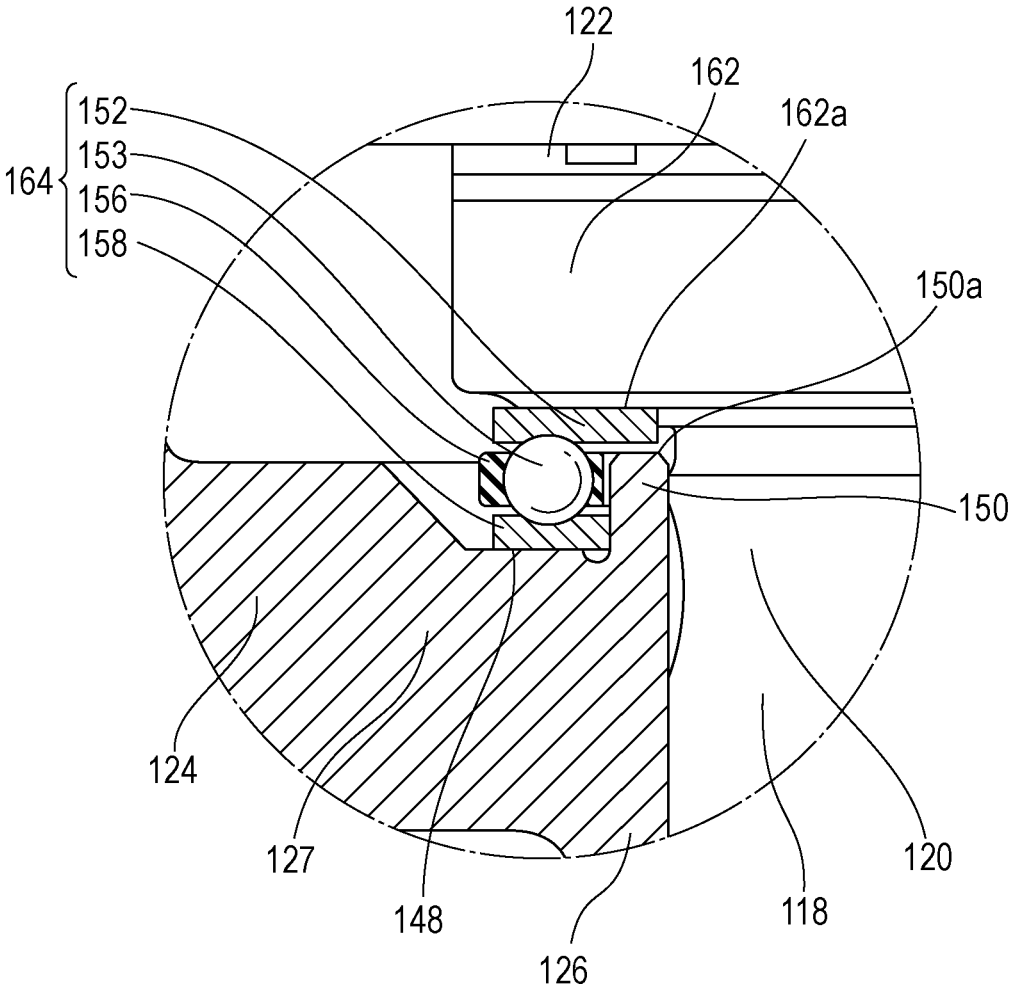
FIG. 9 is a cross-sectional view illustrating an enlarged main part of a thrust ball bearing part included in the sealed compressor according to the fourth exemplary embodiment of the present invention.
Figure 10:
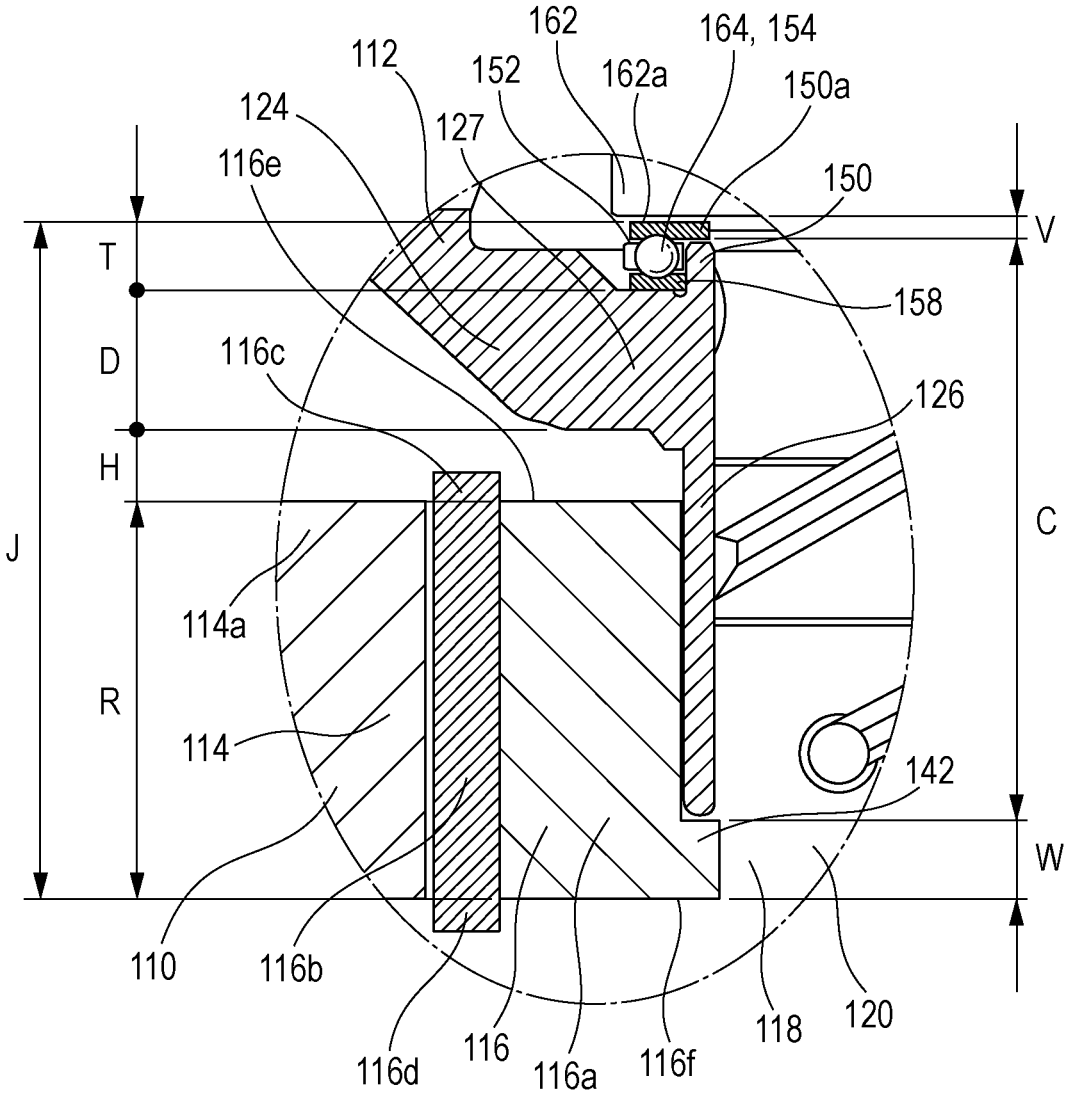
FIG. 10 is a cross-sectional view illustrating an enlarged main part of a main bearing portion of the sealed compressor according to the fourth exemplary embodiment of the present invention.
Figure 11:
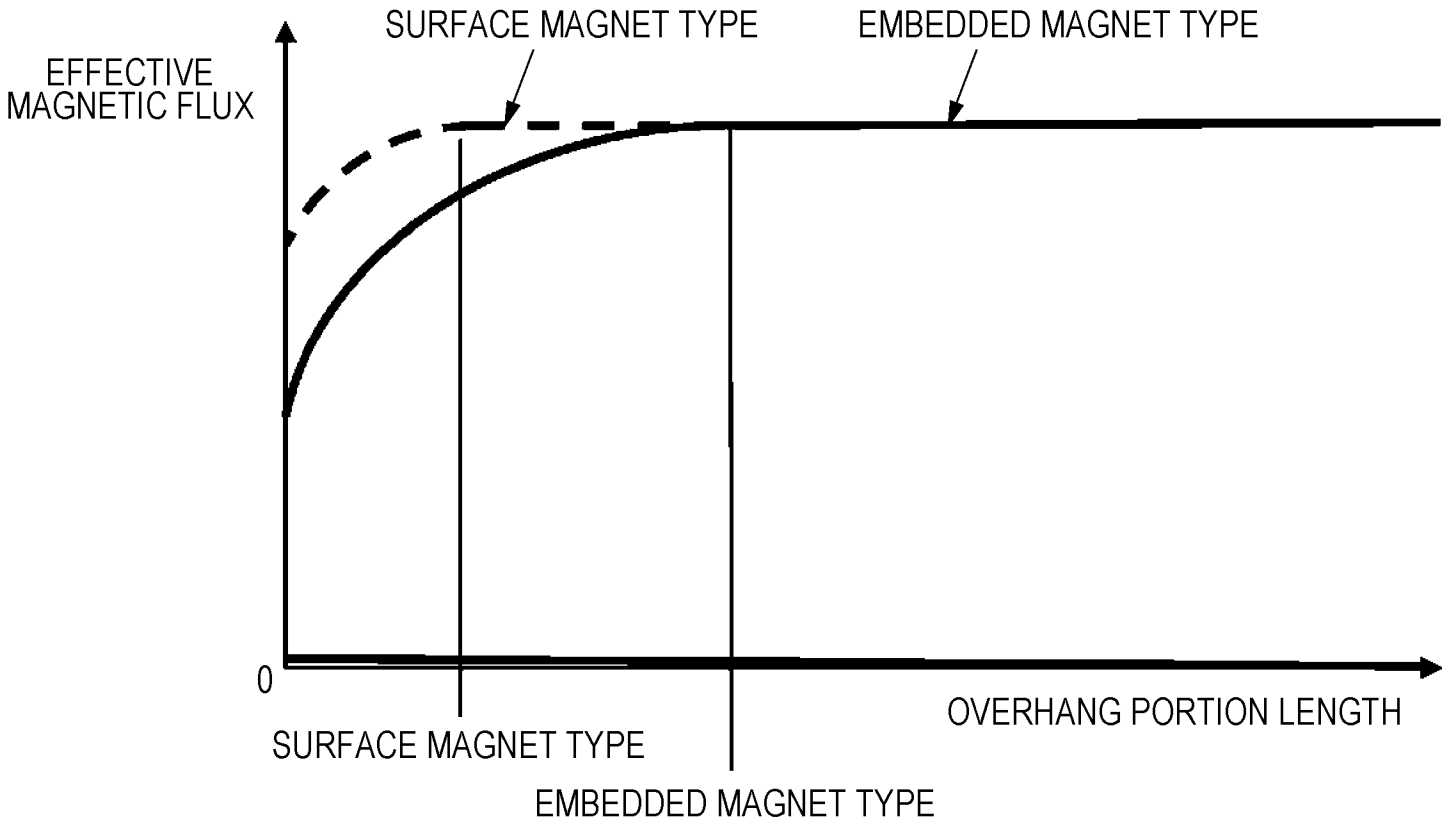
FIG. 11 is a view showing a relationship between effective magnetic flux of a rotor and a length of an overhang portion of the sealed compressor according to the fourth exemplary embodiment of the present invention.
Figure 12A:
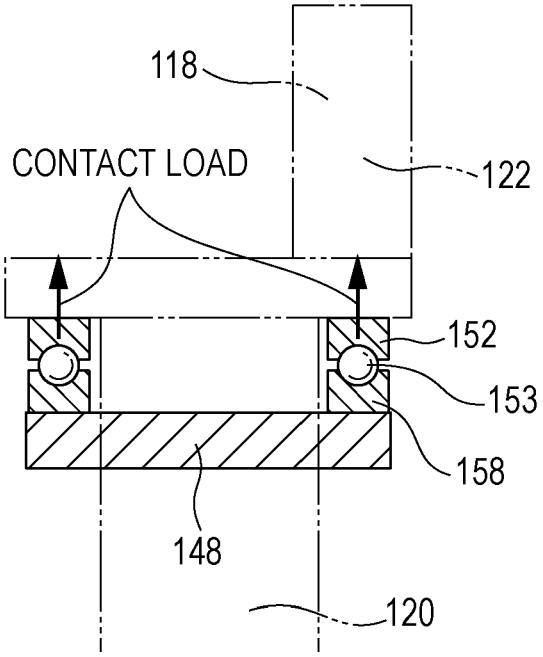
FIG. 12A is a schematic view illustrating a normal state of the thrust ball bearing of the sealed compressor according to the fourth exemplary embodiment of the present invention.
Figure 12B:
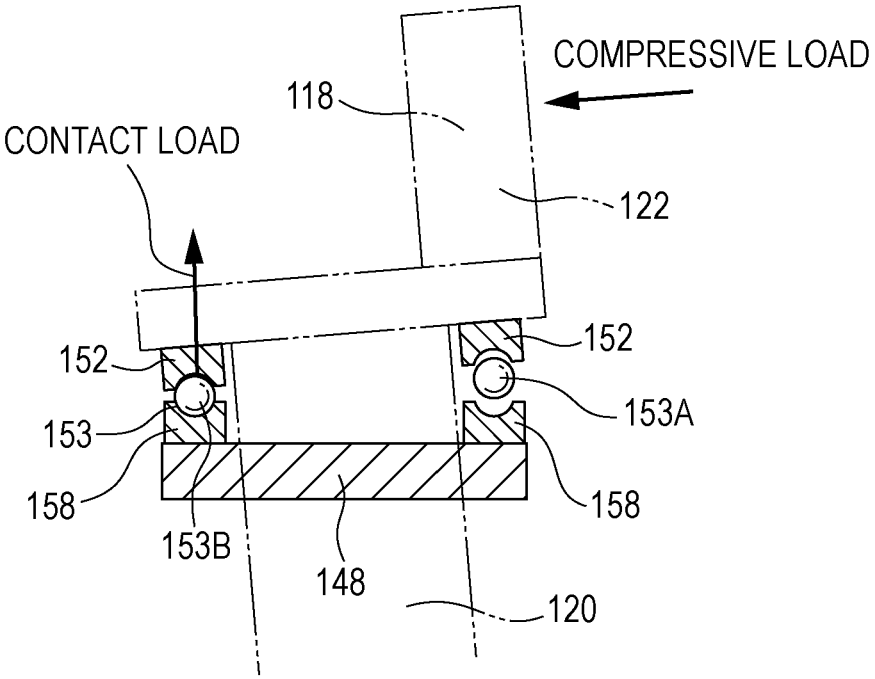
FIG. 12B is a schematic view illustrating an inclined state of a shaft inclined by a compressive load of the thrust ball bearing of the sealed compressor according to the fourth exemplary embodiment of the present invention.

FIG. 8 is a vertical cross-sectional view of a sealed compressor according to a fourth exemplary embodiment of the present invention. FIG. 9 is a cross-sectional view illustrating an enlarged main part of a thrust ball bearing portion of the sealed compressor according to the fourth exemplary embodiment of the present invention. FIG. 10 is a cross-sectional view illustrating an enlarged main part of a main bearing portion included in the sealed compressor according to the fourth exemplary embodiment of the present invention. FIG. 11 is a view showing a relationship between effective magnetic flux and an overhang portion length of a rotor included in the sealed compressor according to the fourth exemplary embodiment of the present invention. FIG. 12A is a schematic view illustrating the thrust ball bearing in a normal condition with respect to inclination of a shaft included in the sealed compressor according to the fourth exemplary embodiment of the present invention. FIG. 12B is a schematic view illustrating the thrust ball bearing in an inclined state of the shaft by a compressive load in the sealed compressor according to the fourth exemplary embodiment of the present invention.

Constituent elements of the sealed compressor according to the fourth exemplary embodiment of the present invention are given reference numbers similar to the reference numbers of the corresponding constituent elements of the first exemplary embodiment of the present invention.

As illustrated in FIGS. 8 through 10, lubricating oil 104 is stored in the bottom portion of sealed container 102. Compressor body 106 is internally suspended in sealed container 102 via suspension spring 108. Sealed container 102 is filled with R600a (isobutane) which is refrigerant gas having a low warming potential value.

Compressor body 106 includes electric unit 110, and compression unit 112 driven by electric unit 110. Power supply terminal 113 is attached to sealed container 102 to supply power to electric unit 110.

Electric unit 110 is initially described.

Electric unit 110 is a surface magnet type DC brushless motor including stator 114 and rotor 116. Stator 114 is of a salient pole concentrated winding type constituted by winding (not shown) directly wound around a plurality of magnetic pole teeth (not shown) of iron core 114*a* via insulating material. Iron core 114*a* includes lamination of steel plates. Rotor 116 includes permanent magnet 116*b* disposed radially inside stator 114 and fixed to a surface of iron core 116*a*.

As illustrated in FIG. 10, dimension R of iron core 116*a* of rotor 116 of the surface magnet type motor in a height direction is equivalent to a dimension of iron core 114*a* of stator 114 in the height direction. More specifically, each of the heights of iron cores 114*a*, 116*a* is 30 mm. Permanent magnet 116*b* fixed to the surface of rotor 116 includes overhang portions 116*c*, 116*d* protruded upward and downward from iron core 116*a* of rotor 116 by 2 mm for each. A height of the permanent magnet is set to 34 mm.

The winding of stator 114 passes through power supply terminal 113, and connects via a lead to an inverter circuit (not shown) disposed outside the sealed compressor. Electric unit 110 is driven at a plurality of rotational frequencies including rotational frequencies higher than 60 Hz corresponding to a commercial power supply frequency.

Figure 17:
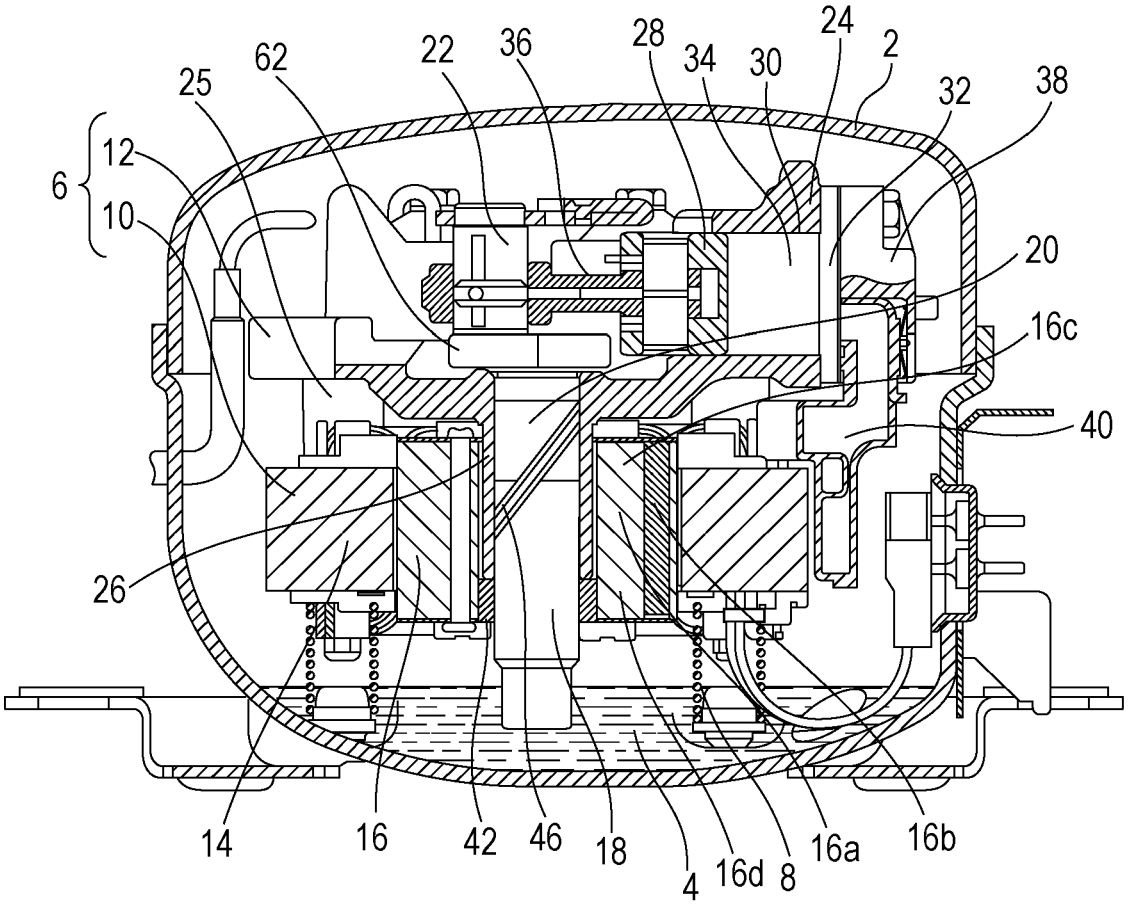
FIG. 17 is a vertical cross-sectional view of a conventional sealed compressor.

Height R of rotor 116 included in electric unit 110 is hereinafter described in comparison with a height of rotor 16 of the conventional embedded magnet type motor illustrated in FIGS. 17, 18.

In general, a height of a rotor corresponds to a sum of a height of an iron core of a stator and lengths of upper and lower overhang portions. FIG. 11 is a view showing a relationship between the lengths of the overhang portions and characteristics of effective magnetic flux, for comparison between the embedded magnet type motor and the surface magnet type motor producing equivalent efficiency and torque.

As indicated at a position "surface magnet type" in FIG. 11, the surface magnet type electric motor has a large amount of effective magnetic flux on the surface of rotor 116 since permanent magnet 116*b* is disposed on the surface. Accordingly, each length of overhang portions 116*c*, 116*d* for saturated effective magnetic flux is allowed to decrease to a smaller length than the corresponding length of rotor 16 of the embedded magnet type electric motor.

Moreover, overhang portions 116*c*, 116*d* of the surface magnet type electric motor need to be provided only on permanent magnet 116*b* provided on the surface to increase an amount of effective magnetic flux. In this case, height R of iron core 116*a* of rotor 116 may be equivalent to the height of iron core 114*a* of stator 114. Accordingly, a height of upper end surface 116*e* of rotor 116 of the surface magnet type electric motor adopted according to this exemplary embodiment is allowed to decrease to a length considerably smaller than the height of upper end surface 16*a* of rotor 16 of the embedded magnet type electric motor included in the conventional sealed compressor illustrated in FIG. 18.

Compression unit 112 is hereinafter described.

Compression unit 112 is disposed above electric unit 110.

Shaft 118 constituting compression unit 112 includes main shaft portion 120, flange portion 162 at an upper end of main shaft portion 120, and eccentric shaft portion 122 rising upward from flange portion 162 and extending in parallel with main shaft portion 120. Rotor 116 is fixed to main shaft portion 120 by shrink fitting.

Cylinder block 124 includes main bearing 126 having a cylindrical inner surface. At least a half of an overall length of main bearing 126 is inserted into a bore formed at a center of rotor 116 and overlapped with rotor 116. Main shaft portion 120 is rotatably inserted into main bearing 126 to support shaft 118. Compression unit 112 has a cantilevered bearing structure which supports a load applied to eccentric shaft portion 122 by using main shaft portion 120 and main bearing 126 disposed below eccentric shaft portion 122.

Cylinder block 124 includes cylinder 130 constituted by a cylindrical bore. Piston 128 is reciprocatively inserted into cylinder 130.

A tip portion of an outer circumferential surface of piston 128 faces an inner circumferential surface of cylinder 130 with a small clearance left between piston 128 and cylinder 130 to constitute sliding portion 166 which maintains airtightness and supports a load.

Connection portion 136 connects eccentric shaft portion 122 and piston 128 by engagement of holes formed at one and the other ends of connection portion 136 with a piston pin (not shown) attached to piston 128 and eccentric shaft portion 122, respectively.

Valve plate 132 is attached to an end surface of cylinder 130 so that compression chamber 134 is constituted by valve plate 132, cylinder 130, and piston 128. Cylinder head 138 is further fixed to cover and cap valve plate 132. Suction muffler 140 for forming a muffled inner space is molded from resin such as polybutylene terephthalate (PBT), and attached to cylinder head 138.

A lower end of main shaft portion 120 of shaft 118 is immersed in lubricating oil 104 stored in the inner bottom portion of sealed container 102 to constitute oil supply mechanism 146. Oil supply mechanism 146 includes spiral groove 144 formed in an external surface of main shaft portion 120 and extended from the lower end to the upper end of shaft 118.

As illustrated in FIG. 9, main bearing 126 includes thrust surface 148 corresponding to a flat surface portion perpendicular to a shaft center, and tubular extension portion 150 that is extended upward from thrust surface 148 and has an inner surface which faces main shaft portion 120. Lower race 158 is disposed above thrust surface 148 and radially outside tubular extension portion 150. Rolling elements 153 constituted by balls, and retainer 156 are disposed above lower race 158. Upper race 152 is further disposed above rolling elements 153 and tubular extension portion 150.

Retainer 156 is an annular flat plate made of resin, and includes a plurality of holes in each of which rolling element 153 constituted by a ball is accommodated. Retainer 156 is freely fitted to the radially outside of tubular extension portion 150 so that retainer 156 and tubular extension portion 150 are freely rotatable relative to each other.

Each of upper race 152 and lower race 158 is an annular flat plate made of metal, and includes a groove formed along a track in contact with balls of rolling elements 153, and sized to be substantially equivalent to each radius of rolling elements 153.

Lower race 158, rolling elements 153, and upper race 152 are disposed on top of one another on thrust surface 148 in this order in contact with each other to constitute thrust bearing 164 functioning as a rolling bearing. Thrust surface 162*a* of flange portion 162 of shaft 118 is seated on an upper surface of upper race 152.

A breakdown of overall height B of sealed container 102 is hereinafter described.

As illustrated in FIG. 8, overall height B of sealed container 102 is a sum of diameter A, length C, height E, height F, height G, and width W.

In this case, height E from a lower end of rotor 116 to a lower end of sealed container 102 includes a clearance between rotor 116 and lubricating oil 104, a depth of lubricating oil 104, and a plate thickness of the bottom portion of sealed container 102. A certain width is needed for the clearance between rotor 116 and lubricating oil 104 to avoid stirring of lubricating oil 104 by rotor 116 even when lubricating oil 104 contains melted refrigerant gas at a startup. In addition, an appropriate amount of lubricating oil 104 is required in view of assurance of reliability; wherefore a certain height is needed for dimension E.

A certain dimension is needed for height F from cylinder 130 to an upper end of main bearing 126.

Height G from an upper end of an inner circumferential surface of cylinder 130 to an upper end of sealed container 102 includes a wall thickness of cylinder block 124, a clearance between sealed container 102 and compressor body 106 internally suspended within sealed container 102, and a plate thickness of a top surface of sealed container 102. A certain dimension is required for a wall thickness of cylinder block 124 to secure airtightness of compression chamber 134. Moreover, a certain clearance is needed between sealed container 102 and compressor body 106 to avoid generation of abnormal noise as a result of collision between internally suspended compressor body 106 and sealed container 102 during operation. Accordingly, height G is required to have a height substantially equivalent to dimension A of piston 128.

A portion corresponding to width W of rotor 116 is fixed to main shaft portion 120 by shrink fitting. A certain dimension is required for width W.

Diameter A is an inside diameter of cylinder 130. A certain dimension is required for diameter A.

Accordingly, overall height B of sealed container 102 is determined by length C.

Length C is hereinafter described with reference to the figure.

Length C corresponds to a height of main bearing 126 of cylinder block 124.

Length C is defined in a following manner on the basis of thrust surface 162*a* of flange portion 162 of shaft 118. Length C corresponds to a height calculated by subtracting distance V between thrust surface 162*a* and upper end 150*a* of tubular extension portion 150, and width W of shrinkage portion 142 of rotor 116, from height J between thrust surface 162*a* of flange portion 162 and lower end surface 116*f* of rotor 116 as illustrated in FIG. 10.

Operation and effect of the sealed compressor constructed as above are hereinafter described.

When electric unit 110 is energized via power supply terminal 113, rotor 116 is rotated together with shaft 118 by a magnetic field generated in stator 114. Eccentric rotation of eccentric shaft portion 122 produced by rotation of main shaft portion 120 is transmitted to connection portion 136, and converted into movement for reciprocating piston 128 within cylinder 130. This reciprocating movement changes a volume of compression chamber 134, and causes compression operation of sucking refrigerant gas from sealed container 102 into compression chamber 134 to compress the refrigerant gas.

In this suction step during the compression operation, the refrigerant gas within sealed container 102 is intermittently sucked into compression chamber 134 via suction muffler 140, and compressed within compression chamber 134. The resultant high-temperature and high-pressure refrigerant gas passes through discharge piping 149 and the like, and travels toward a freezing cycle (not shown).

Lubricating oil 104 stored in the bottom portion of sealed container 102 is supplied upward from the lower end of shaft 118, and scattered from a tip of eccentric shaft portion 122 by operation of oil supply mechanism 146 operating in accordance with rotation of shaft 118.

During the compression operation, a compressive load is applied to eccentric shaft portion 122 of shaft 118 from piston 128 via connection portion 136. As a result, main shaft portion 120 of shaft 118 is inclined within the clearance between main shaft portion 120 and main bearing 126.

According to this exemplary embodiment, a support member included in a conventional sealed compressor is eliminated. In this case, height T of thrust bearing 164 is smaller than the height of conventional thrust ball bearing 64 by the length of the support member. Accordingly, thickness D of support portion 127 is allowed to increase by the corresponding length.

Furthermore, the surface magnet type motor is adopted in this exemplary embodiment. In this case, each of height R and a height of upper end surface 116*e* of rotor 116 is allowed to decrease to a height considerably smaller than the height of upper end surface 16*e* of rotor 16 of the conventional embedded magnet type motor. This structure allows further increase in thickness D of support portion 127.

Figure 18:
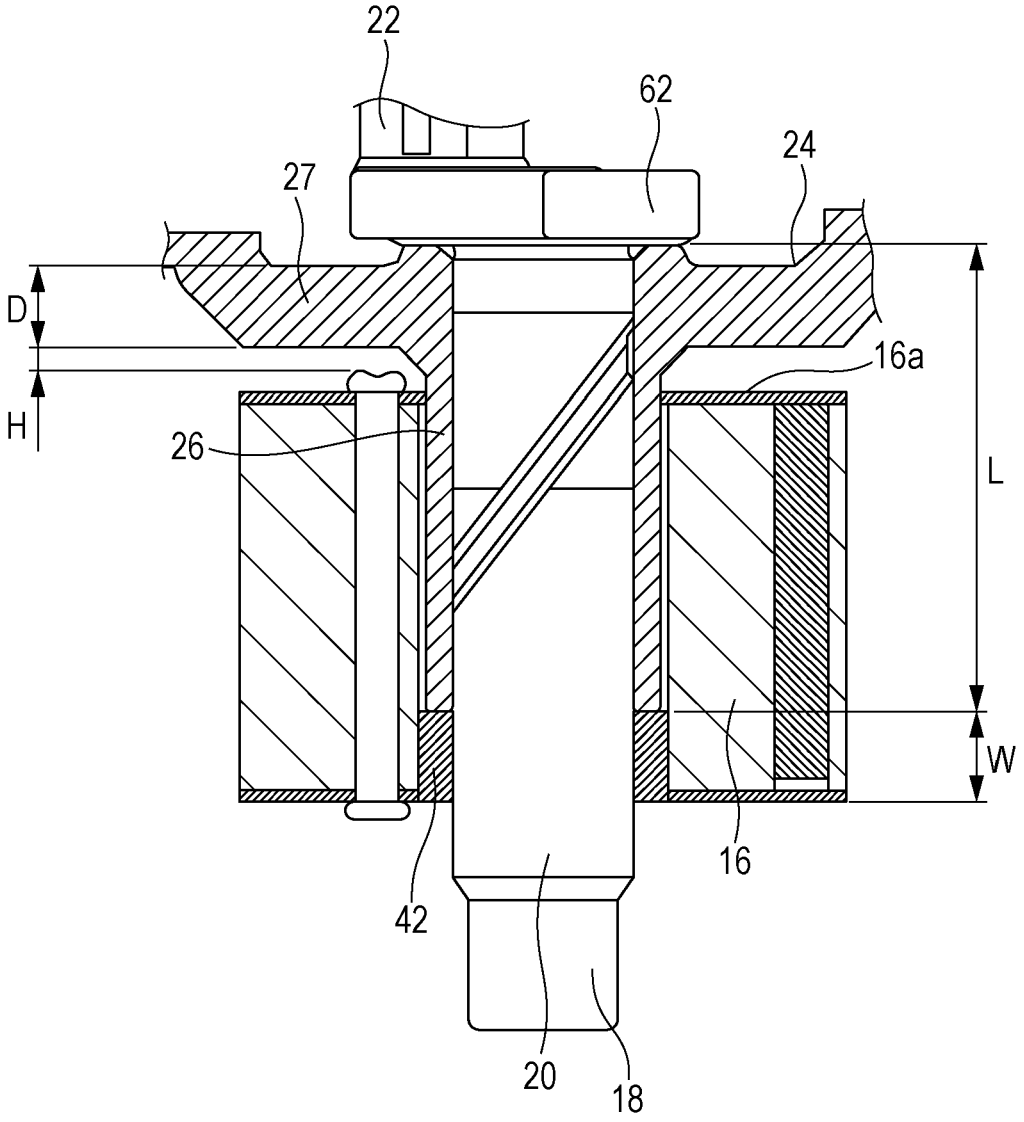
FIG. 18 is a cross-sectional view illustrating an enlarged main part of a thrust bearing portion included in the conventional sealed compressor illustrated in FIG. 17.
Figure 19:
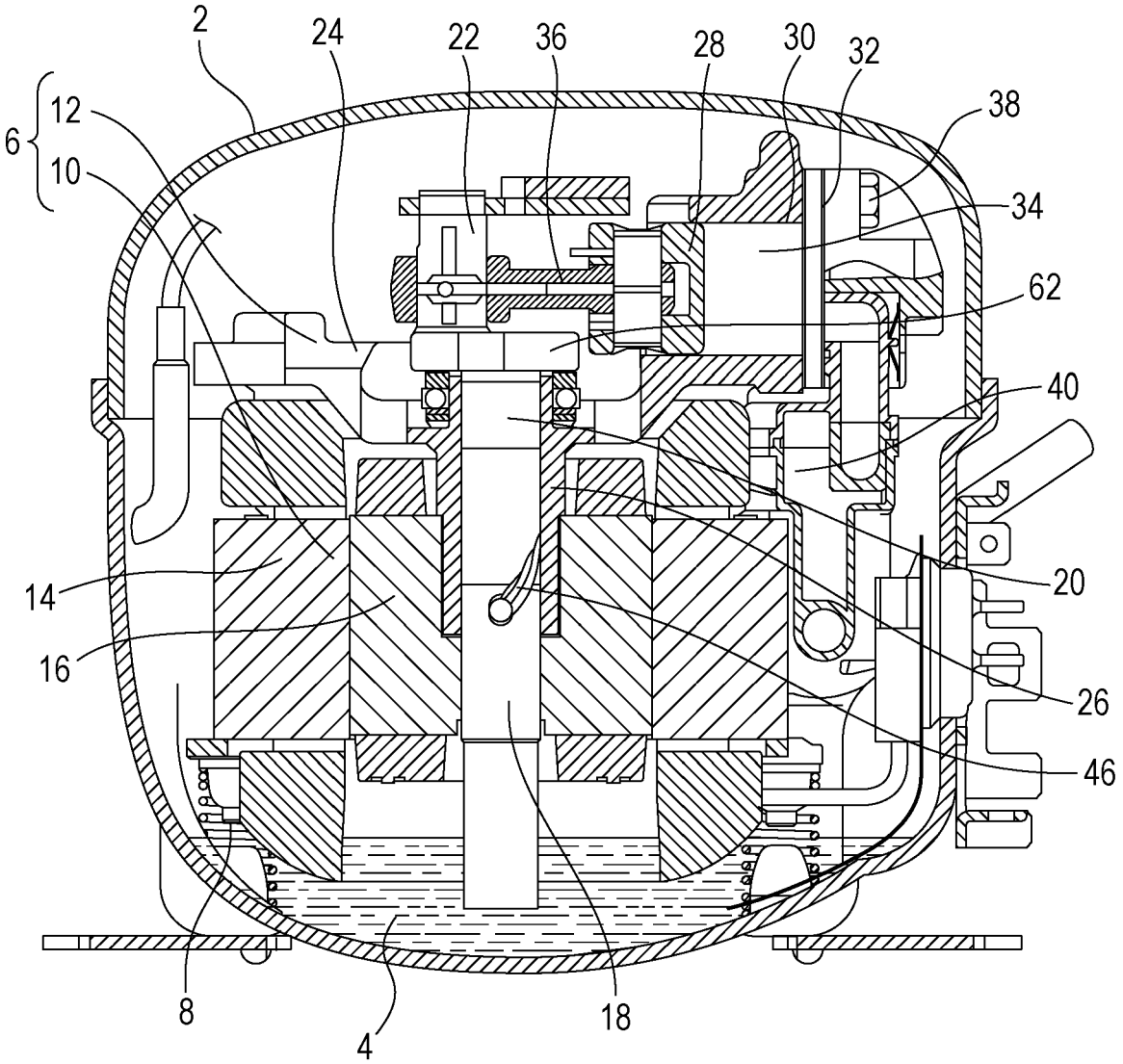
FIG. 19 is a vertical cross-sectional view of another conventional sealed compressor.
Figure 20:
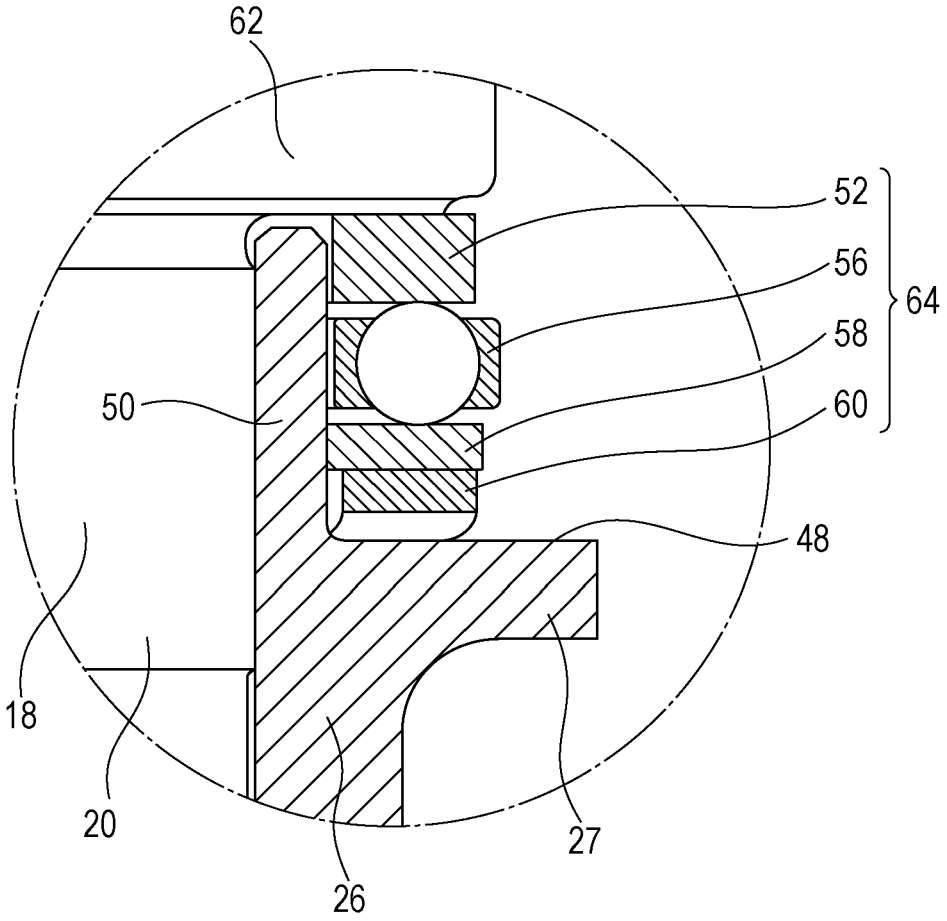
FIG. 20 is a cross-sectional view illustrating an enlarged main part of a thrust ball bearing portion included in the conventional sealed compressor illustrated in FIG. 19.
Figure 21:
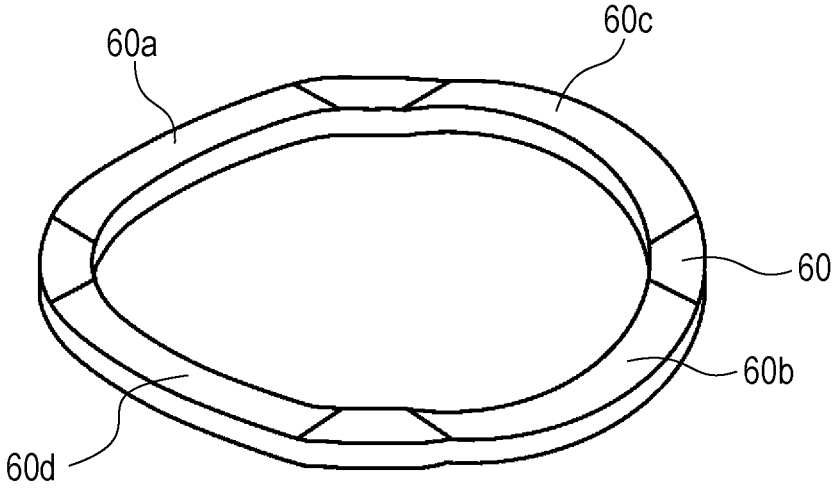
FIG. 21 is a perspective view of a support member included in the conventional sealed compressor illustrated in FIG. 20.
Figure 22A:
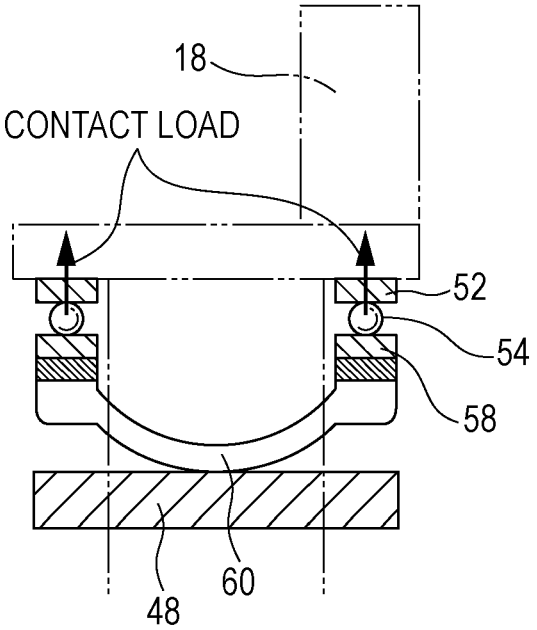
FIG. 22A is a schematic view illustrating a normal state of the thrust ball bearing of the conventional sealed compressor illustrated in FIG. 20.
Figure 22B:
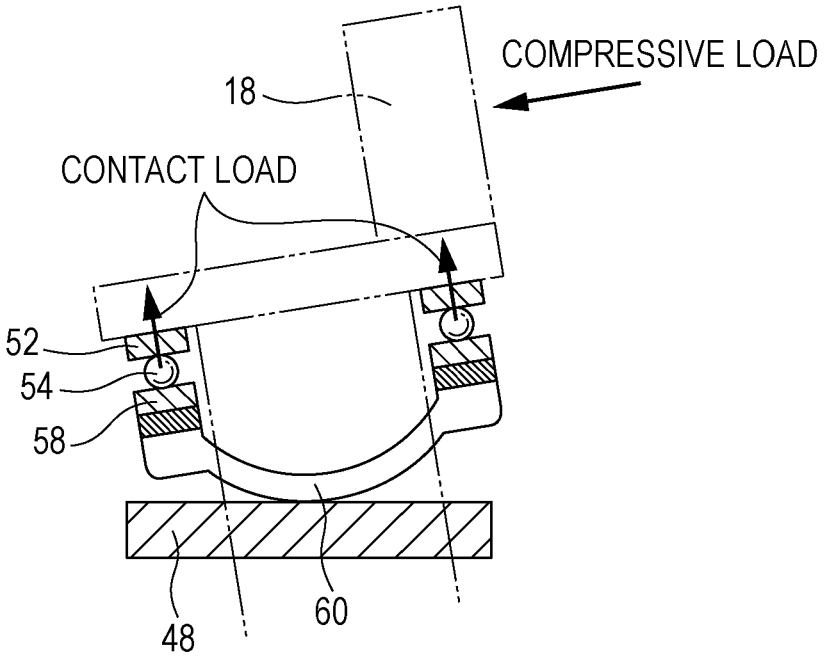
FIG. 22B is a schematic view illustrating an inclined state of a shaft inclined by a compressive load of the thrust ball bearing of the conventional sealed compressor illustrated in FIG. 20.

Accordingly, rigidity of support portion 127 of this exemplary embodiment is higher than the rigidity of support portion 27 of conventional cylinder block 24 illustrated in FIG. 18; wherefore deformation decreases. As a result, a bearing loss of main shaft portion 120 decreases by reduction of inclination of main shaft portion 120.

Furthermore, this reduction of inclination of main shaft portion 120 reduces inclination of piston 128 within cylinder 130 during reciprocating movement of piston 128 achieved via eccentric shaft portion 122 of shaft 118 and connection portion 136. This structure decreases local abrasion produced by twisting between piston 128 and cylinder 130, thereby reducing leakage of refrigerant gas from compression chamber 134. Accordingly, volumetric efficiency of the sealed compressor improves.

Operation of thrust bearing 164 is hereinafter described with reference to FIGS. 12A, 12B.

FIG. 12A illustrates a state where a compressive load is not applied. In this state, a vertical load such as a weight of shaft 118 is uniformly supported at contact points between balls of rolling elements 153 and upper and lower races 152 and 158. Accordingly, respective contact loads are small.

However, when shaft 118 is inclined by an effect of anticlockwise moment generated by a compressive load as illustrated in FIG. 12B, rolling elements 153A corresponding to right balls are separated from upper race 152 and lower race 158. In this condition, no contact load is produced between the right balls and upper and lower races 152 and 158.

However, large contact loads are applied between rolling elements 153B corresponding to left balls and upper and lower races 152 and 158.

In this case, clockwise moment in a direction opposite to the anticlockwise moment generated by the compressive load is applied to shaft 118 by the contact loads. Accordingly, inclination of shaft 118 caused by the compressive load decreases.

Accordingly, mixed lubrication due to local oil films produced by partial contact between main shaft portion 120 and main bearing 126 receiving the compressive load is avoidable; wherefore a bearing loss decreases.

Moreover, inclination of piston 128 connected with shaft 118 via connection portion 136 also decreases; wherefore deterioration of performance and efficiency caused by leakage of refrigerant gas from compression chamber 134 through the clearance between piston 128 and cylinder 130 is avoidable.

When contact between rolling elements 153 constituted by balls and upper and lower races 152 and 158 are non-uniform as in this example, large contact loads are applied to particular rolling elements 153. However, the circular-arc-shaped grooves formed in upper race 152 and lower race 158 produce substantially linear contact between rolling elements 153 and upper and lower races 152 and 158, in which condition a contact area therebetween microscopically increases. Accordingly, durability of rolling elements 153 is securable.

Furthermore, the grooves thus formed decrease contact pressure at the contact points between balls of rolling elements 153 and upper and lower races 152 and 158. In this case, damage to rolling elements 153 and upper and lower races 152 and 158 is avoidable even when impact is given at the time of transfer of the sealed compressor. Accordingly, reliability of the sealed compressor improves.

Furthermore, the grooves are formed in upper race 152 and lower race 158 of thrust bearing 164 along the track in contact with rolling elements 153 constituted by balls. This structure produces the following effects even at a rotational frequency exceeding 60 Hz corresponding to a commercial frequency. Rolling elements 153 are pressed against side surfaces of the grooves of upper race 152 and lower race 158 by centrifugal force acting on the balls of rolling elements 153. Accordingly, reliability of the sealed compressor improves by prevention of damage caused by a slip of rolling elements 153.

According to this exemplary embodiment, rolling elements 153 are constituted by balls. However, rolling elements 153 may be constituted by rollers (a bearing including rolling elements constituted by balls or rollers is referred to as a thrust bearing). In this case, the contact portions produce linear contact and decrease contact pressure even when grooves are not formed in upper race 152 and lower race 158. As a result, damage to rolling elements 153 and upper and lower races 152 and 158 is avoidable even when impact is given during transfer of the sealed compressor. Accordingly, reliability of the sealed compressor improves.

Fifth Exemplary Embodiment

Figure 13:
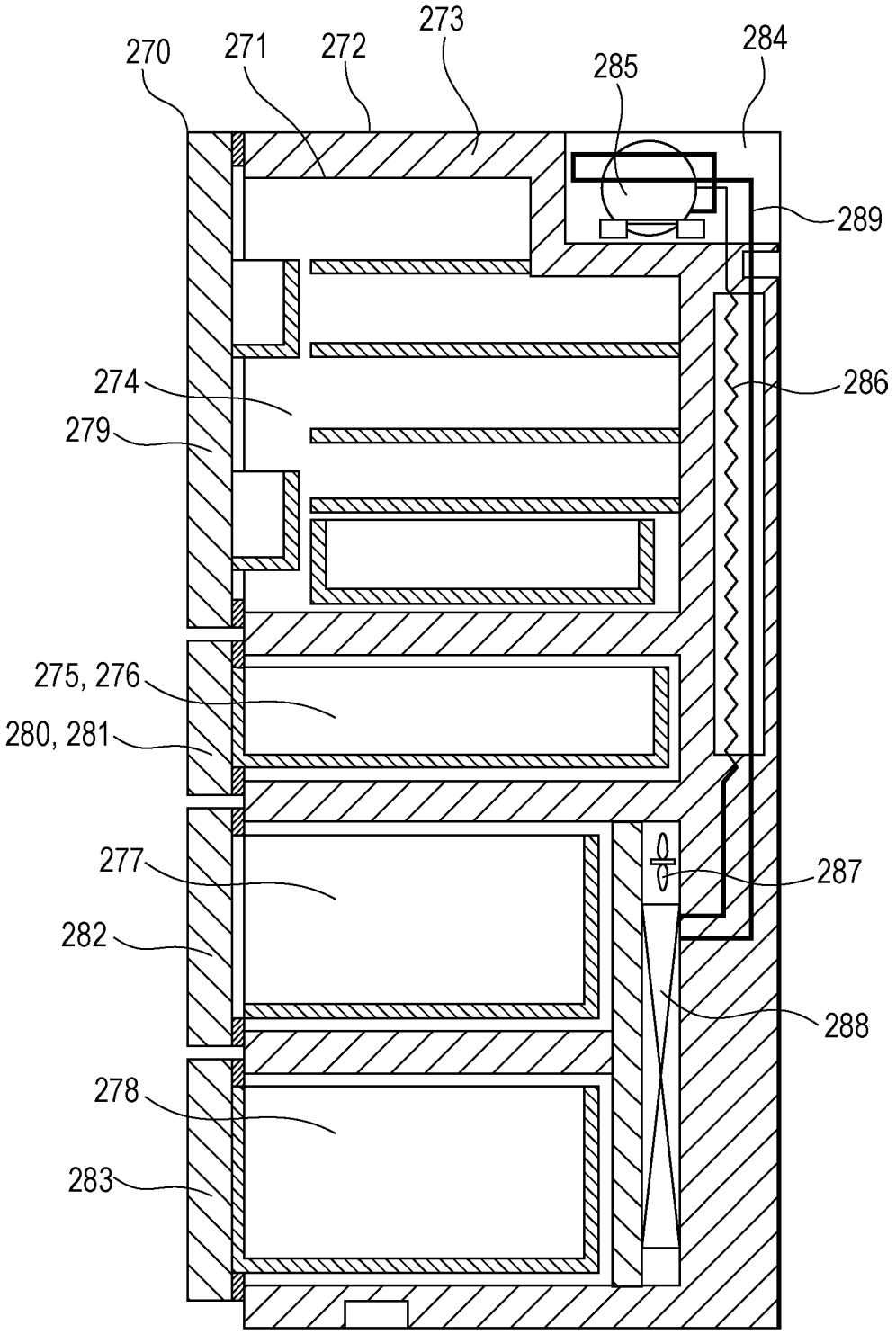
FIG. 13 is a cross-sectional view schematically illustrating a refrigerator according to a fifth exemplary embodiment of the present invention.

FIG. 13 is a cross-sectional view schematically illustrating a refrigerator according to a fifth exemplary embodiment of the present invention, which includes a sealed compressor according to the fifth exemplary embodiment of the present invention.

Constituent elements included in the refrigerator according to the fifth exemplary embodiment of the present invention are given reference numbers similar to the reference numbers of the corresponding constituent elements of the refrigerator of the third exemplary embodiment of the present invention.

As illustrated in FIG. 13, heat insulating box 270 includes inner box 271 constituted by a vacuum-formed resin body such as ABS (acrylonitrile-butadiene-styrene copolymers), and outer box 272 made of metal material such as precoated sheet steel. Heat insulating box 270 further includes insulating walls produced by injecting heat insulator 273 into a space formed by inner box 271 and outer box 272, and foaming heat insulator 273 in the space. Heat insulator 273 is constituted by rigid urethane foam, phenolic foam, or styrene foam, for example. It is preferable that foaming material is constituted by hydrocarbon-based cyclopentane in view of global warming prevention.

Heat insulating box 270 is divided into a plurality of heat insulating sections. An upper part of heat insulating box 270 is equipped with a pivoted door, while a lower part of heat insulating box 270 is equipped with drawers. Refrigerating compartment 274 is disposed in the upper part. Below refrigerating compartment 274 are provided drawer-type switching compartment 275 and ice compartment 276 located side by side in a horizontal direction. Below both compartments 275 and 276 is drawer-type vegetable compartment 277. Below vegetable compartment 277 is drawer-type freezing compartment 278.

A heat insulating door is provided via a gasket for each of the heat insulating sections. Refrigerating compartment pivoted door 279 is disposed in the upper part. Below refrigerating compartment pivoted door 279 are switching compartment drawer door 280 and ice compartment drawer door 281. Below both doors 280 and 281 is vegetable compartment drawer door 282. Below vegetable compartment drawer door 282 is freezing compartment drawing door 283.

Outer box 272 of heat insulating box 270 includes recess portion 284 corresponding to a recessed rear top surface.

A freezing cycle is constituted by annular connection of sealed compressor 285 elastically supported on recess portion 284, a condenser (not shown), capillary 286, a drier (not shown), evaporator 288 disposed on the rear of vegetable compartment 277 and freezing compartment 278, and suction piping 289. Cooling fan 287 is provided in the vicinity of evaporator 288.

Sealed compressor 285 is constituted by the sealed compressor described in the fourth exemplary embodiment.

Operation and effect of the refrigerator thus constructed are hereinafter described.

Temperature settings and cooling systems for the respective heat insulation sections are hereinafter described.

A compartment temperature of refrigerating compartment 274 is generally set within a range from 1° C. to 5° C. above a freezing temperature for refrigerated storage.

A temperature setting of switching compartment 275 is changeable by a user between predetermined temperatures within a range from a freezing compartment temperature zone to a vegetable compartment temperature zone. Ice compartment 276 is an independent ice storage compartment, and includes a not-shown automatic ice making device for automatically producing ice and storing produced ice. A compartment temperature of ice compartment 276 lies in the freezing temperature zone for storing ice. However, this temperature may be set to a freezing temperature in a range from −18° C. to −10° C., a range relatively higher than the freezing temperature zone for the purpose of storing ice only.

A compartment temperature of vegetable compartment 277 is often set in a range from 2° C. to 7° C., a temperature equivalent to or slightly higher than the compartment temperature of refrigerating compartment 274. Leafy vegetables maintain freshness for a longer period as the storage temperature is set to a lower temperature within such a range that the vegetables do not freeze.

A compartment temperature of freezing compartment 278 is generally set in a range from −22° C. to −18° C. for freezing storage. However, this temperature may be set to a lower temperature, such as −30° C. and −25° C., for improvement of freezing storage conditions.

The respective compartments are sectioned by heat insulating walls to efficiently maintain different temperature settings. In this case, heat insulator 273 may be integrally injected and foamed for cost reduction and improvement of heat insulating performance. By injection of heat insulator 273, heat insulating performance increases to approximately twice higher than heat insulating performance of a heat insulating material such as styrene foam. Accordingly, a storage volume is allowed to increase by reduction of a partitioning thickness.

Operation of the freezing cycle is hereinafter described.

Cooling operation is started or stopped based on temperatures set for the refrigerator in accordance with signals generated from a temperature sensor (not shown) and a control board. Sealed compressor 285 performs predetermined compression operation in accordance with instructions of cooling operation. Discharged high-temperature and high-pressure refrigerant gas releases heat, and condenses and liquefies at a condenser (not shown). The refrigerant becomes low-temperature and low-pressure liquefied refrigerant as a result of pressure reduction by capillary 286, and flows to evaporator 288.

The refrigerant gas in evaporator 288 is evaporated and vaporized by heat exchange with air contained in the refrigerator in accordance with operation of cooling fan 287. The low-temperature cool air after the heat exchange is distributed to the respective compartments by using a damper (not shown) or the like to cool the respective compartments.

Sealed compressor 285 performing the foregoing operation is constituted by the sealed compressor having a reduced overall height as described in the fourth exemplary embodiment. According to this structure, a height of recess portion 284 decreases in a state of attachment of sealed compressor 285. Accordingly, usability of the refrigerator improves by enlargement of an inside volume of the refrigerator.

Moreover, sealed compressor 285 includes the thrust bearing to reduce losses, and bearing losses by reducing inclination of the shaft within the main bearing caused by a compressive load. In this case, inclination of the piston within the cylinder further decreases, whereby leakage of refrigerant gas from the compression chamber through the clearance between the piston and the cylinder decreases. Accordingly, power consumption of the refrigerator decreases based on improvement of efficiency of the compressor.

Furthermore, reliability of the sealed compressor improves by reduction of contact pressure based on linear contact of contact portions of the rolling elements of the rolling bearing. Accordingly, reliability of the refrigerator improves.

As described above, usability of the refrigerator increases by enlargement of an inside volume of the refrigerator. Moreover, power consumption of the refrigerator decreases based on higher efficiency of the sealed compressor. Accordingly, reliability of the refrigerator increases with improvement of reliability of the sealed compressor.

Sixth Exemplary Embodiment

Figure 14:
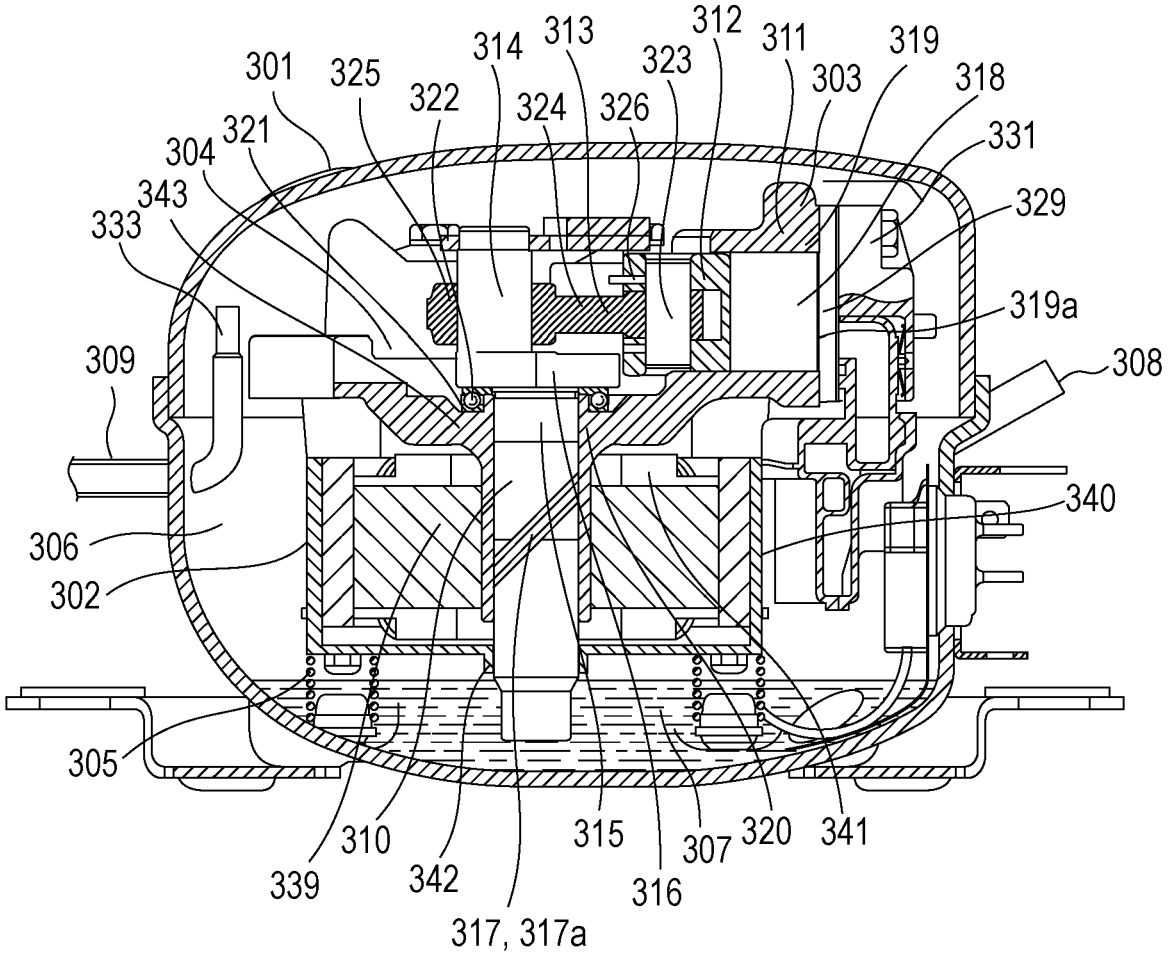
FIG. 14 is a vertical cross-sectional view of a sealed compressor according to a sixth exemplary embodiment of the present invention.
Figure 15:
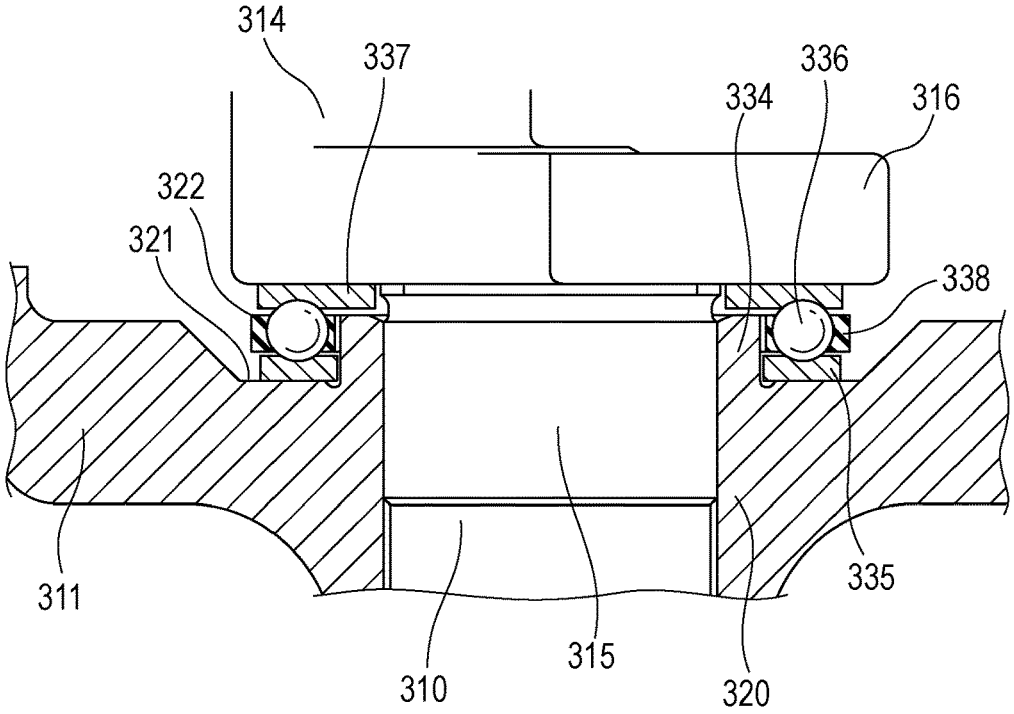
FIG. 15 is a cross-sectional view illustrating an enlarged main part of a thrust ball bearing included in the sealed compressor according to the sixth exemplary embodiment of the present invention.

FIG. 14 is a vertical cross-sectional view of a sealed compressor according to a sixth exemplary embodiment of the present invention. FIG. 15 is a cross-sectional view illustrating an enlarged main part of a thrust bearing of the sealed compressor according to the sixth exemplary embodiment of the present invention.

As illustrated in FIGS. 14, 15, the sealed compressor according to this exemplary embodiment includes electric unit 302 and compressor body 304, both housed in sealed container 301 produced by a drawn iron plate. Compressor body 304 is chiefly constituted by compression unit 303 and driven by electric unit 302. Compressor body 304 is elastically supported by suspension spring 305.

Refrigerant gas 306, which contains R600a that is hydrocarbon having a small global warming potential, is sealed into sealed container 301 at a pressure equivalent to a low pressure of a freezer device (not shown) and at a relatively low temperature, for example. On the other hand, lubricating oil 307 is sealed into a bottom portion of sealed container 301.

Sealed container 301 includes suction pipe 308 and discharge pipe 309. One end of suction pipe 308 communicates with an inner space of sealed container 301, while the other end of suction pipe 308 connects with the freezer device (not shown). Discharge pipe 309 guides refrigerant gas compressed by compression unit 303 toward the freezer device (not shown).

Compression unit 303 includes shaft 310, cylinder block 311, piston 312, and connection portion 313. Shaft 310 includes eccentric shaft portion 314, main shaft portion 315, flange portion 316 provided at an upper end of main shaft portion 315, and oil supply mechanism 317 communicatively extending to an upper end of eccentric shaft portion 314 from a lower end of main shaft portion 315 immersed in lubricating oil 307. Spiral groove 317*a* is formed in a surface of main shaft portion 315 in an intermediate portion of oil supply mechanism 317.

Cylinder 319 constituting compression chamber 318 is formed integrally with cylinder block 311. Cylinder block 311 includes main bearing 320 supporting main shaft portion 315 such that main shaft portion 315 is rotatable, and thrust bearing 322 disposed above thrust surface 321 and supporting a load of shaft 310 in a vertical direction.

Piston 312 reciprocates within cylinder 319, and includes piston pin 323 disposed such that a shaft center of piston pin 323 extends in parallel with a shaft center of eccentric shaft portion 314.

Connection portion 313 includes rod portion 324, large end hole 325, and small end hole 326. Large end hole 325 engages with eccentric shaft portion 314, while small end hole 326 engages with piston pin 323. Eccentric shaft portion 314 and piston 312 are connected to each other by engagement of these holes.

Valve plate 329 including a suction hole and a discharge hole, a suction valve for opening and closing the suction hole, and cylinder head 331 for closing valve plate 329 are jointly fixed via a head bolt (not shown) to opening end surface 319*a* of cylinder 319 on the side different from the shaft 310 side.

Cylinder head 331 contains a discharge space to which refrigerant gas 306 is discharged. The discharge space directly communicates with discharge pipe 309 via a discharge pipe (not shown).

As illustrated in FIG. 15, main bearing 320 includes tubular extension portion 334 that is extended upward from thrust surface 321 and has an inner surface which faces main shaft portion 315. Thrust bearing 322 is disposed above thrust surface 321 and radially outside tubular extension portion 334.

Thrust bearing 322 includes lower race 335, rolling elements 336 constituted by balls, and upper race 337 disposed on top of one another on thrust surface 321 in this order in contact with each other. Flange portion 316 of shaft 310 is seated on an upper surface of upper race 337.

Each of upper race 337 and lower race 335 is an annular flat plate made of metal, and includes a groove (not shown) formed along a track in contact with balls of rolling elements 336, and sized to be substantially equivalent to each radius of rolling elements 336.

Each of rolling elements 336 is accommodated in corresponding one of a plurality of holes formed in retainer 338. Retainer 338 is an annular flat plate made of resin. An inside diameter surface of retainer 338 and an outside diameter surface of tubular extension portion 334 are freely fitted to each other so that retainer 338 and tubular extension portion 334 are freely rotatable with respect to each other.

As illustrated in FIG. 14, electric unit 302 includes stator 339 fixed to an outer circumference of main bearing 320 by press fit or other methods, and rotor 340 outside stator 339 which is disposed coaxially with stator 339 and fixed to main shaft portion 315 by shrink fitting or other methods. Stator 339 and rotor 340 constitute an outer rotor motor. An inside diameter of insulator 341 of stator 339 is larger than an outside diameter of thrust bearing 322. A length of rotor 340 in a height direction is larger than a corresponding length of stator 339. Accordingly, rotor 340 protrudes upward and downward from stator 339.

A lower end of main bearing 320 extends downward from a lower end of stator 339. Fixing portion 342 between rotor 340 and the main shaft is disposed below a lower end of main bearing 320.

Operation and effect of the sealed compressor constructed as above are hereinafter described.

Suction pipe 308 and discharge pipe 309 of the sealed compressor are connected with a freezer device (not shown) having a known configuration to constitute a freezing cycle.

When electric unit 302 of this structure is energized, current flows in stator 339. As a result, rotor 340 fixed to main shaft portion 315 is rotated by generation of a magnetic field. The rotation of rotor 340 further rotates shaft 310, whereby piston 312 reciprocates within cylinder 319 via connection portion 313 rotatably attached to eccentric shaft portion 314.

In accordance with this reciprocation of piston 312, refrigerant gas 306 is sucked into compression chamber 318 for compression, and discharged from compression chamber 318 after compression.

During this compression step, piston 312 receives compression reaction force from refrigerant gas 306 compressed within compression chamber 318. This compression reaction force presses eccentric shaft portion 314 in a bottom dead center direction via connection portion 313. As a result, main shaft portion 315 is slightly inclined within a range of a clearance between main shaft portion 315 and main bearing 320.

For reducing an overall height of a conventional sealed compressor, reduction of a length of main bearing 320 is needed as a consequence. Reduction of the length of main bearing 320 increases inclination of main shaft portion 315 when the clearance between main shaft portion 315 and main bearing 320 is kept unchanged.

According to this exemplary embodiment, however, electric unit 302 is constituted by an outer motor rotor. In this case, main bearing 320 penetrates stator 339 disposed inside, and extends long to reach the position of fixing portion 342 between main shaft portion 315 and rotor 340 below the lower end of stator 339. In this case, a maximum inclination angle of shaft 310 within main bearing 320 decreases.

As a result, inclination of piston 312 connected with shaft 310 via connection portion 313 within cylinder 319 decreases; wherefore deterioration of efficiency and reliability caused by twisting between piston 312 and cylinder 319 is avoidable.

Moreover, winding is not wound around a portion of stator 339 located inside an inside diameter of insulator 341; wherefore this portion has a smaller height. This structure allows enlargement of a wall thickness of support portion 343 around main bearing 320 of cylinder block 311. More specifically, for providing thrust bearing 322 without increasing the height of the compressor, it is necessary to reduce a wall thickness of support portion 343 by an amount corresponding to a space required for accommodating thrust bearing 322. According to this exemplary embodiment, an outside diameter of thrust bearing 322 is located inside the inside diameter of insulator 341; wherefore a sufficient wall thickness of support portion 343 is secured. In this case, rigidity of cylinder block 311 increases; wherefore reduction of deformation of main bearing 320 caused by a compressive load, and therefore reduction of inclination of shaft 310 are achievable. As a result, inclination of piston 312 within cylinder 319 decreases. Accordingly, deterioration of efficiency and reliability are avoidable by reduction of a sliding loss and abrasion produced by twisting between piston 312 and cylinder 319.

Furthermore, the grooves formed along the tracks of upper race 337 and lower race 335 of thrust bearing 322 reduce the height of thrust bearing 322 by an amount of a groove depth. This structure allows reduction of a space necessary for accommodating thrust bearing 322, and therefore allows further increase in the wall thickness of support portion 343 by the corresponding amount. The increased wall thickness of support portion 343 raises rigidity of cylinder block 311, thereby reducing deformation of main bearing 320 caused by a compressive load. In this case, inclination of shaft 310 decreases. As a result, inclination of piston 312 within cylinder 319 decreases. Accordingly, deterioration of efficiency and reliability are avoidable by reduction of a sliding loss and abrasion produced by twisting between piston 312 and cylinder 319.

Rolling elements 336 constituted by balls and upper and lower races 337 and 335 are in a state close to linear contact with each other. In this case, contact pressure at contact points decreases. Accordingly, damage to rolling elements 336 and upper and lower races 337 and 335 is avoidable even when impact is given during transfer of the sealed compressor. As a result, reliability of the sealed compressor improves.

When the sealed compressor according to this exemplary embodiment is rotated at a low speed by inverter driving, an effect of inertia of rotor 340 increases in comparison with an inner rotor motor which disposes a rotor inside. In this condition, torque fluctuations are allowed to decrease; wherefore efficiency improves by elimination of the necessity of complicated control.

Seventh Exemplary Embodiment

Figure 16:
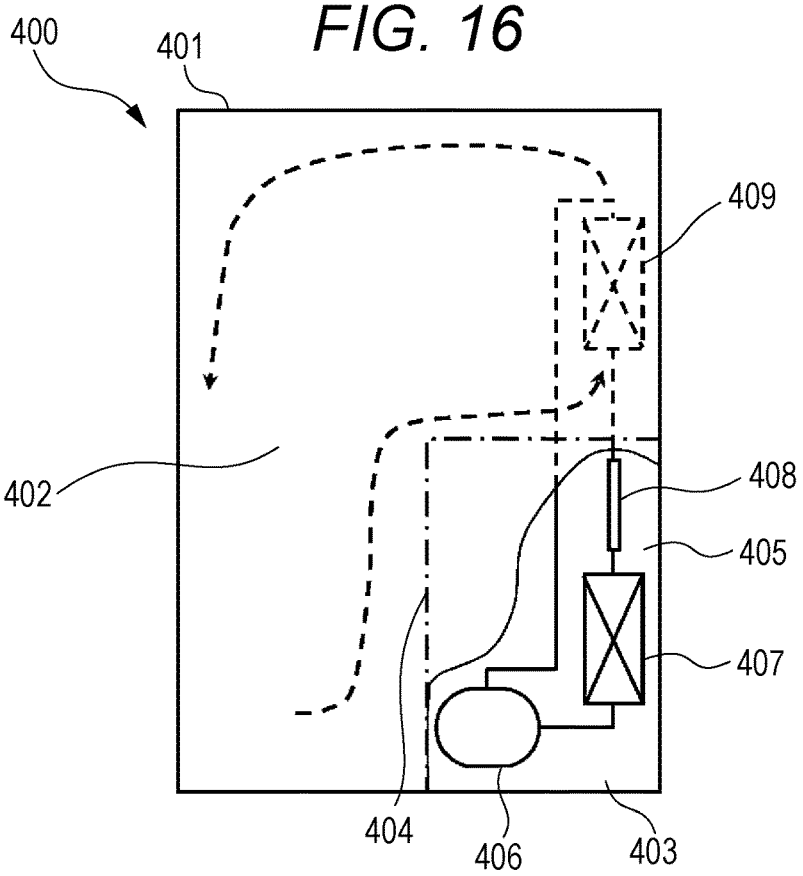
FIG. 16 is a schematic view illustrating a configuration of a freezer device according to a seventh exemplary embodiment of the present invention.

FIG. 16 is a schematic view illustrating a configuration of a freezer device according to a seventh exemplary embodiment of the present invention. A refrigerant circuit of the freezer device according to this exemplary embodiment includes the sealed compressor described in the sixth exemplary embodiment of the present invention. An outline of a basic configuration of the freezer device is hereinafter described.

As illustrated in FIG. 16, freezer device 400 includes body 401, sectioning walls 404, and refrigerant circuit 405. Body 401 is constituted by a heat insulating box including an opening equipped with a door. Section walls 404 divide an interior of body 401 into article storage space 402 and machinery chamber 403. Refrigerant circuit 405 cools an interior of storage space 402.

Refrigerant circuit 405 includes annular piping connection which connects sealed compressor 406 having the configuration described in the sixth exemplary embodiment of the present invention, radiator 407, pressure reducer 408, and heat absorber 409.

Heat absorber 409 is disposed within storage space 402 housing a blower (not shown). Cooling heat from heat absorber 409 is stirred by the blower, and circulates within storage space 402 as indicated by arrows of broken line.

The freezer device discussed herein includes sealed compressor 406 having the configuration described in the sixth exemplary embodiment of the present invention. Accordingly, the freezer device achieves energy saving. More specifically, the sealed compressor described in the sixth exemplary embodiment of the present invention offers advantages of reduction of a sliding loss and abrasion produced by twisting between a piston and a cylinder, and prevention of damage to a thrust bearing, as well as improvement of efficiency based on operation of the thrust bearing. Moreover, torque fluctuations at low speed revolutions decrease without a need for control; wherefore efficient driving is achievable. As a result, efficiency and reliability improve. Accordingly, the freezer device including this sealed compressor decreases power consumption, and achieves energy saving.

Moreover, reduction of the height of the sealed compressor is allowed according to the sixth exemplary embodiment of the present invention. This height reduction contributes to reduction of a space for housing the compressor. Accordingly, an inside volume of the freezer device of this exemplary embodiment is allowed to increase.

INDUSTRIAL APPLICABILITY

Provided according to the present invention described herein are a sealed compressor capable of increasing efficiency while reducing an overall height of a sealed container, and a freezer device such as a refrigerator including this sealed compressor. The sealed compressor and the freezer device are applicable to a wide variety of freezer devices, such as air conditioners and vending machines, as well as household electric freezing and refrigerating devices.

REFERENCE MARKS IN THE DRAWINGS

2,102,202,301 Sealed container
4,104,204,307 Lubricating oil
8,108,208,305 Suspension spring
10,110,210,302: Electric unit
12,112,212,303: Compression unit
14,114,214,339: Stator
16,116,216,340: Rotor
18,118,218,310: Shaft
20,120,220,315: Main shaft portion
22,122,222,314: Eccentric shaft portion
24,124,224,311: Cylinder block
26,126,226,320: Main bearing
28,128,228,312: Piston
30,130,230,319: Cylinder
36,136,236,313: Connection portion
**48,148,162*a*,248,321** Thrust surface
50,150,250,334: Tubular extension unit
52,152,252,337: Upper race
153,153A,153B,253,336 Rolling element
56,156,256,338: Retainer
58,158,258,335: Lower race
62,162,262,316: Flange portion
64,164,264,322: Thrust bearing
168,268 Non-sliding portion
251 Expansion portion
285 Sealed compressor
341 Insulator
400 Freezer device
405 Refrigerant circuit
406 Sealed compressor
407 Radiator
408 Pressure reducer
409 Heat absorber

The invention claimed is:

1. A sealed compressor comprising:

a sealed container that stores lubricating oil and contains an electric unit equipped with a stator and a rotor; and a compression unit disposed above the electric unit, wherein the compression unit comprises:

a shaft that includes a main shaft portion to which the rotor is fixed, and an eccentric shaft portion, a cylinder block that includes a cylinder, a piston reciprocatively inserted into the cylinder, a connection portion that connects the piston and the eccentric shaft portion, a main bearing provided in the cylinder block and supporting a load applied to the main shaft portion of the shaft in a radial direction, and a thrust bearing that supports a load of the shaft in a vertical direction, the thrust bearing is a rolling bearing that includes an upper race in contact with a flange portion of the shaft, a lower race in direct contact with a thrust surface of the cylinder block, a retainer, and a rolling element in contact with the upper race and the lower race, the retainer having a plurality of holes into which the rolling element is accommodated, an overall height of the sealed container is sized not to exceed a length six times larger than a diameter of the piston, at least half of an overall length of the main bearing is inserted into a bore formed at a center of the rotor, wherein an upper end of the main shaft portion forms an expansion portion, the expansion portion having a larger diameter than a diameter of the main shaft portion, wherein the retainer of the thrust bearing is freely fitted to an outside diameter side of the expansion portion, and the lower race is arranged below the expansion portion, and wherein a length of the main bearing is set in a range from 1.5 times larger than the diameter of the piston to twice as large as the diameter of the piston.

2. The sealed compressor according to claim 1, wherein the rolling element comprises a plurality of balls, and a groove is formed in each of the upper race and the lower race along a track in contact with the rolling element.

3. The sealed compressor according to claim 1, wherein a non-sliding portion is provided on a bearing side of an outside diameter of the piston or on the bearing side of an inside diameter of the cylinder.

4. The sealed compressor according to claim 1, further comprising:

a tubular extension portion extended upward from the thrust surface of the cylinder block.

5. A refrigerator comprising the sealed compressor according to any one of claims 1, 2, 3, and 4.

6. The sealed compressor according to claim 1, wherein the rotor is disposed radially inside the stator.

7. The sealed compressor according to claim 1, wherein a length of the rotor is larger than a length of the stator in a height direction, and the rotor protrudes upward and downward from the stator in the height direction.

8. The sealed compressor according to claim 1, wherein a winding of the stator passes through a power supply terminal and connects to an inverter circuit via a lead.

* * * * *